US009496101B2

(12) United States Patent
Oneufer et al.

(10) Patent No.: US 9,496,101 B2
(45) **Date of Patent: *Nov. 15, 2016**

(54) DISCONNECT OPERATING HANDLES SUITABLE FOR CIRCUIT BREAKERS AND RELATED BUCKET ASSEMBLIES AND HANDLE INTERLOCKS

(71) Applicant: Eaton Corporation, Cleveland, OH (US)

(72) Inventors: Stephen William Oneufer, Fayetteville, NC (US); Edgar Yee, Fayetteville, NC (US); Robert Allan Morris, Fayetteville, NC (US); Daniel Boyd Kroushl, Clayton, NC (US)

(73) Assignee: Eaton Corporation, Cleveland, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/524,585

(22) Filed: Oct. 27, 2014

(65) Prior Publication Data

US 2015/0221459 A1 Aug. 6, 2015

Related U.S. Application Data

(63) Continuation-in-part of application No. 14/174,481, filed on Feb. 6, 2014.

(51) Int. Cl.

| | |
|---|---|
| ***H01H 9/28*** | (2006.01) |
| ***H01H 71/56*** | (2006.01) |
| *H01H 9/16* | (2006.01) |

(52) U.S. Cl.

CPC ..... *H01H 9/281* (2013.01); *H01H 9/282* (2013.01); *H01H 71/56* (2013.01); *H01H 9/161* (2013.01); *H01H 2071/565* (2013.01); *H01H 2219/036* (2013.01); *H01H 2219/0621* (2013.01)

(58) Field of Classification Search

CPC ..... H01H 9/223; H01H 9/161; H01H 9/18; H01H 9/20; H01H 9/28; H01H 9/281; H01H 9/286

USPC ..... 200/43.11, 43.14–43.16, 43.19, 43.21

See application file for complete search history.

(56) References Cited

U.S. PATENT DOCUMENTS

| | | | |
|---|---|---|---|
| 3,155,786 | A | 11/1964 | Stegmaier |
| 4,024,441 | A | 5/1977 | Coyle et al. |

(Continued)

FOREIGN PATENT DOCUMENTS

| | | |
|---|---|---|
| EP | 2393092 | 12/2011 |
| WO | WO2011/012806 | 2/2011 |

OTHER PUBLICATIONS

Product Brochure, Rotary handles, Molded-case circuit breakers, EATON, Jun. 2013, 5 pages.

(Continued)

*Primary Examiner* — Renee Luebke
*Assistant Examiner* — Lheiren Mae A Caroc
(74) *Attorney, Agent, or Firm* — Myers Bigel & Sibley, P.A.

(57) ABSTRACT

Disconnect operating handles for circuit breakers are configured with a rotary handle attached to an inwardly oriented shaft that connects to a gear assembly that translates rotational input to linear input. The disconnect operating handles include pivoting lockout levers that can automatically "pop" out to expose the lockout space for a padlock when a user touches the lever in an appropriate location.

22 Claims, 34 Drawing Sheets

(56) References Cited

U.S. PATENT DOCUMENTS

| | | | | |
|---|---|---|---|---|
| 4,503,408 | A | 3/1985 | Mrenna et al. | |
| 4,612,424 | A | 9/1986 | Clark et al. | |
| 4,679,019 | A | 7/1987 | Todaro et al. | |
| D297,726 | S | 9/1988 | Araki | |
| 4,851,621 | A | 7/1989 | Borchardt et al. | |
| D349,101 | S | 7/1994 | Schaeffer | |
| 5,493,083 | A | 2/1996 | Olivier | |
| 5,634,553 | A | 6/1997 | Hopper et al. | |
| 5,687,834 | A | 11/1997 | Simon et al. | |
| D404,014 | S | 1/1999 | Barnard et al. | |
| 5,910,760 | A | 6/1999 | Malingowski et al. | |
| 6,194,983 | B1 | 2/2001 | Bogdon et al. | |
| D438,846 | S | 3/2001 | Bonn | |
| 6,423,912 | B1 | 7/2002 | Arenz et al. | |
| 6,518,526 | B2 | 2/2003 | Hamada et al. | |
| 6,596,952 | B1 | 7/2003 | Degrazia et al. | |
| 6,767,104 | B2 | 7/2004 | Worrell | |
| 6,797,903 | B1 | 9/2004 | Winslett et al. | |
| 6,903,289 | B2 * | 6/2005 | Tongo | H01H 73/14 200/310 |
| 6,969,813 | B1 | 11/2005 | Winslett et al. | |
| 7,002,088 | B2 | 2/2006 | Shin | |
| 7,186,933 | B2 | 3/2007 | Turner | |
| 7,214,895 | B2 | 5/2007 | Houck et al. | |
| 7,238,903 | B2 | 7/2007 | Fischer | |
| D559,206 | S | 1/2008 | Neveu | |
| 7,399,934 | B2 | 7/2008 | Emura et al. | |
| 7,420,133 | B2 | 9/2008 | Farrow et al. | |
| D580,880 | S | 11/2008 | Lifran | |
| D606,026 | S | 12/2009 | Azzola et al. | |
| D635,104 | S | 3/2011 | Louise et al. | |
| D641,711 | S | 7/2011 | Azzola et al. | |
| 8,642,903 | B2 | 2/2014 | Sadowski et al. | |
| 2007/0272526 | A1 | 11/2007 | Ishido et al. | |
| 2009/0167468 | A1 | 7/2009 | Dauer et al. | |
| 2010/0032278 | A1 | 2/2010 | Lin | |
| 2010/0294632 | A1 | 11/2010 | Reddering et al. | |
| 2013/0056340 | A1 | 3/2013 | Serpinet et al. | |
| 2013/0077210 | A1 | 3/2013 | Morris | |
| 2014/0238829 | A1 | 8/2014 | Takatsu et al. | |
| 2014/0326585 | A1 | 11/2014 | Reinhart et al. | |
| 2015/0008108 | A1 | 1/2015 | Wu et al. | |
| 2015/0053537 | A1 | 2/2015 | Manhan | |
| 2015/0103472 | A1 | 4/2015 | Oneufer et al. | |
| 2015/0221458 | A1 * | 8/2015 | Oneufer | H01H 9/223 200/43.15 |

OTHER PUBLICATIONS

International Search Report and Written Opinion for corresponding PCT Application No. PCT/US2015/012350, date of mailing Apr. 25, 2015, 13 pages.

Chilean Office Action for related Chilean application No. 2014-003378, dated Oct. 22, 2015, 6 pages.

Chilean Office Action for related Chilean application No. 2014-003379, dated Oct. 22, 2015, 6 pages.

Chilean Office Action for related Chilean application No. 2014-002395, dated Aug. 31, 2015, 6 pages.

Chilean Office Action for related Chilean application No. 2014-002396, dated Aug. 31, 2015, 6 pages.

* cited by examiner

DISCONNECT OPERATING HANDLES SUITABLE FOR CIRCUIT BREAKERS AND RELATED BUCKET ASSEMBLIES AND HANDLE INTERLOCKS

RELATED APPLICATIONS

This application is a continuation-in-part of U.S. patent application Ser. No. 14/174,481, filed Feb. 6, 2014, the contents of which are hereby incorporated by reference as if recited in full herein.

FIELD OF THE INVENTION

The present invention relates to circuit breakers and may be particularly suitable for Motor Control Center (MCC) units.

BACKGROUND OF THE INVENTION

As is known to those of skill in the art, Motor Control Centers (MCC) can include cabinets or enclosures that hold multiple, typically modular, bucket assemblies or units of various sizes. See, e.g., U.S. Pat. No. 4,024,441, the contents of which are hereby incorporated by reference as if recited in full herein. Eaton Corporation has recently introduced a MCC product line with compact bucket assemblies that conveniently plug into a slot or space in an MCC cabinet. The product is sold under the product name, Freedom 2100 MCC. See also, U.S. Patent Application Publication Serial Number US2013/0077210, the contents of which are hereby incorporated by reference as if recited in full herein.

The bucket assemblies or units can include rotary handles that are disposed on the front door. The rotary handle can be configured to convert the rotary motion of the rotary handle to the linear or translational motion of a circuit breaker linear action lever. See, e.g., U.S. Pat. Nos. 6,194,983 and 7,186,933, the contents of which are incorporated by reference as if recited in full herein. The rotary handle is typically mounted parallel with the plane of the faceplate of the molded case circuit breaker, but spaced outwardly from it by the depth of the handle mechanism. Usually a series of linkages are utilized to interconnect the rotary motion of the rotary handle to the linear motion of the circuit breaker handle or lever.

Workplace guidelines, such as regulatory guidelines including National Fire Protection Association (NFPA) standards 70 National Electrical Code, and No. 70 E Personal and Other Protective Equipment, require a "Lockout and Tagout" procedure. FIG. 1 illustrates an example of a prior art operator disconnect handle accessed by a technician wearing a glove pursuant to personal protective equipment (PPE) requirements in applying a Lockout/Tagout padlock.

Despite the above, there remains a need for alternate operator disconnect handle designs that can facilitate human interfaces with the handles to comply with safety regulations and/or provide an easier to use configuration.

SUMMARY OF EMBODIMENTS OF THE INVENTION

Embodiments of the invention provide disconnect operating handles for circuit breakers with enhanced safety features and/or easy to use configuration to facilitate user interaction.

Embodiments of the invention provide disconnect operating handles which can provide an externally visible visual indication of the status of the circuit breaker so that an observer can tell whether the circuit breaker is conducting electrical current or blocking electrical current.

Embodiments of the invention are directed to disconnect operator handles. The handles include: (a) a cover having an elongate channel; (b) an elongate lockout lever having opposing spaced apart first and second end portions held in the elongate channel, the second end portion of the elongate lockout lever configured to pivot outward from the elongate channel and expose a lockout passage residing under an outer surface of the lever; (c) a lever pivot pin attached to the elongate lever to pivotably hold the lever in the elongate channel; and (d) at least one resilient member residing under and in communication with the lever. The at least one resilient member pushes the lever to expose the lockout passage in response to when a user depresses the lever at a defined location.

The elongate lever can have a transverse channel residing in a medial portion of the lever between the first and second end portions and the lever pivot pin resides in the transverse channel.

The disconnect operator handle can include a handle core with outwardly extending spaced apart walls, each with a respective pivot pin holder. The lever can reside between the handle core walls with the lever pivot pin extending into the handle core pivot pin holders. The operator handle can also include at least one lockout pin held by the first end portion of the lever, the at least one lockout pin can extend inwardly below the cover. The handle can also include a magnetic latch with at least one permanent magnet held by the handle core under a second end portion of the lever. The magnetic latch can be configured to latch the lever to the handle core so that the handle core, outer cover and lever can rotate as a unit when latched.

The disconnect operator handle can include at least one lockout pin held by the first end portion of the elongate lever. The at least one lockout pin can extend inwardly.

The disconnect operator handle can include a handle core with outwardly extending spaced apart walls, each with a respective pivot pin holder. The lever can reside between the handle core walls with the lever pivot pin extending into the pivot pin holders.

The at least one resilient member can reside under the lever pivot pin in a cavity in a handle core and is configured to be held trapped between a leg extending below the lever in the cavity in at least a partially compressed state while being able to flex angularly in the cavity to move radially inward and outward at a top portion thereof to thereby provide rotational torque for a toggle-assist action of the handle between operative positions.

The at least one resilient member can be or include a spring held under the pivot pin of the lever that presses outward against a bottom surface of the lever to force the second end portion of the lever to pivot outward.

The disconnect operator handle can include at least one light illuminating segment proximate the lever or in the lever that is externally visible.

The disconnect operator handle can include a base that holds the cover with the elongate lever to a housing panel of a circuit breaker and allows the cover and lever to rotate through defined operational positions. The base can hold a drive shaft holder and can include an aperture that slidably receives the at least one lockout pin to inhibit or prevent handle rotation out of a defined operating position when the lever is extended to expose the lockout space.

The resilient member can include a spring held under the second end portion of the lever that presses outward against a bottom surface of the second end portion of the lever to force the lever to pivot outward.

The disconnect operator handle can include a handle core residing under the cover with outwardly extending spaced apart walls, each with a respective pivot pin holder. The lever can reside between the handle core walls with the lever pivot pin extending into the pivot pin holders. The disconnect operator may also include a base that resides under and is attached to the handle core, the base adapted to hold the handle core, the cover with the elongate lever to a housing panel of a circuit breaker and allows the handle core, the cover and the lever to rotate as a unit through defined operational positions. The disconnect operator handle may also include at least one lockout pin held by the first end portion of the elongate lever, the at least one lockout pin extending inwardly a length sufficient to extend through an aperture in the base to lock the handle core, cover and lever in a defined operational position when the second end portion of the lever is pivoted outward to expose the lockout space and the first end portion of the elongate lever is pivoted inward.

The at least one lockout pin may be a single lockout pin and includes an aperture in atop end portion thereof, the disconnect operator further comprising a retainer pin extending through the single lockout pin and extending through a cooperating front end portion of the elongate lever.

The base aperture can have a curvilinear configuration adapted to allow a limited defined circumferential movement of the cover, lever and core unit in the OFF position.

The disconnect operator can include at least one inwardly extending lockout pin held by the front end portion of the lever and a circular handle core residing under the cover. The handle core can have an outer surface that includes pair of outwardly extending spaced apart walls, each with a respective pivot pin holder. The lever can reside between the handle core walls with the lever pivot pin extending into the pivot pin holders.

The handle core can include an aperture residing on an outer perimeter aligned with the first end portion of the lever to allow the at least one lockout pin to extend therethrough and a resilient member retention feature or member residing between the walls under the second end portion of the lever.

The outer surface of the handle core can include a flat segment between the walls and a segment that angles toward the front end portion of the lever. The pivot pin holders can reside above and adjacent a peak that transitions the flat segment to the angled segment.

The disconnect operator can include at least one light illuminating segment proximate the lever or in the lever that is externally visible and a light guide extending through the handle core to a location between the second end portion of the lever and an external surface of the cover thereat. The light guide can include a light pipe held by the handle core and the cover.

Still other embodiments are directed to a bucket assembly for a circuit breaker. The assembly including an external rotary operating mechanism disconnect handle having a defined ON position and OFF position associated with conduction and non-conduction and a shaft attached to the rotary handle and extending into the bucket assembly. The operating mechanism disconnect handle can include: (a) a base fixedly attached to the bucket assembly; (b) an outer cover with an elongate channel attached to the base; (c) an elongate lockout lever having opposing spaced apart first and second end portions held in the elongate channel of the outer cover, the second end portion of the elongate lockout lever configured to pivot outward from the elongate channel and expose a lockout passage residing under an outer surface of the lever; (d) a lever pivot pin attached to the elongate lever to pivotably hold the lever in the elongate channel; and (e) at least one resilient member residing under and in communication with the lever. The at least one resilient member can automatically push the lever outward to expose the lockout passage in response to when a user depresses the lever and the outer cover with the lever can rotate to the defined ON and OFF positions while the base remains in a fixed position attached to the bucket assembly.

The rotary handle can include at least one lockout pin held by the first end portion of the elongate lever. The at least one lockout pin can extend inwardly a length sufficient to extend through an aperture in the base to lock the cover and lever in a defined operational position when the second end portion of the lever is pivoted outward to expose the lockout space and the first end portion of the elongate lever is pivoted inward.

The rotary handle can include a circular handle core residing between the base and cover. The handle core can include an outer surface with a pair of outwardly extending spaced apart walls, each with a respective pivot pin holder. The lever can reside between the handle core walls with the lever pivot pin extending into the pivot pin holders.

The handle core can include an aperture residing on an outer perimeter portion to be aligned with the first end portion of the lever to allow the at least one lockout pin to extend therethrough. The handle core can also include a resilient member retention feature or member residing between the walls under the second end portion of the lever. The outer surface of the handle core can include a flat segment between the walls and a segment that angles inward (down) toward the front end portion of the lever. The pivot pin holders can reside above and adjacent a peak that transitions the flat segment to the angled segment.

The bucket assembly can include at least one light illuminating segment residing proximate the lever and/or in the lever that is externally visible and at least one light guide extending through the rotary handle from a light source held in the bucket assembly to the at least one light illuminating segment.

The light source can include a plurality of LEDs (light emitting diodes) in different colors that selectively communicate with the at least one light guide to selectively illuminate the light illuminating segment with a color associated with a defined operational condition or status of the circuit breaker in the bucket assembly.

The base may optionally include a circumferentially extending cantilevered arm on an inner perimeter thereof that cooperates with underlying aligned surface features at respective ON and OFF/RESET positions to provide a detent for the handle.

The at least one resilient member can reside under the lever pivot pin in a cavity in the handle core and is configured to be held trapped between a leg extending below the lever in the cavity in at least a partially compressed state while being able to flex angularly in the cavity to move radially inward and outward at a top portion thereof to thereby provide rotational torque for a toggle-assist action of the handle between operative positions.

The operating mechanism disconnect handle may also include a circular handle core residing between the base and cover and a magnetic latch comprising at least one permanent magnet held by the handle core under a second end portion of the lever, and wherein the magnetic latch is configured to latch the lever to the handle core so that the handle core, outer cover and lever can rotate as a unit when latched.

Further features, advantages and details of the present invention will be appreciated by those of ordinary skill in the art from a reading of the figures and the detailed description of the preferred embodiments that follow, such description being merely illustrative of the present invention.

It is noted that aspects of the invention described with respect to one embodiment, may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail in the specification set forth below.

DETAILED DESCRIPTION OF EMBODIMENTS OF THE INVENTION

Figure 1:
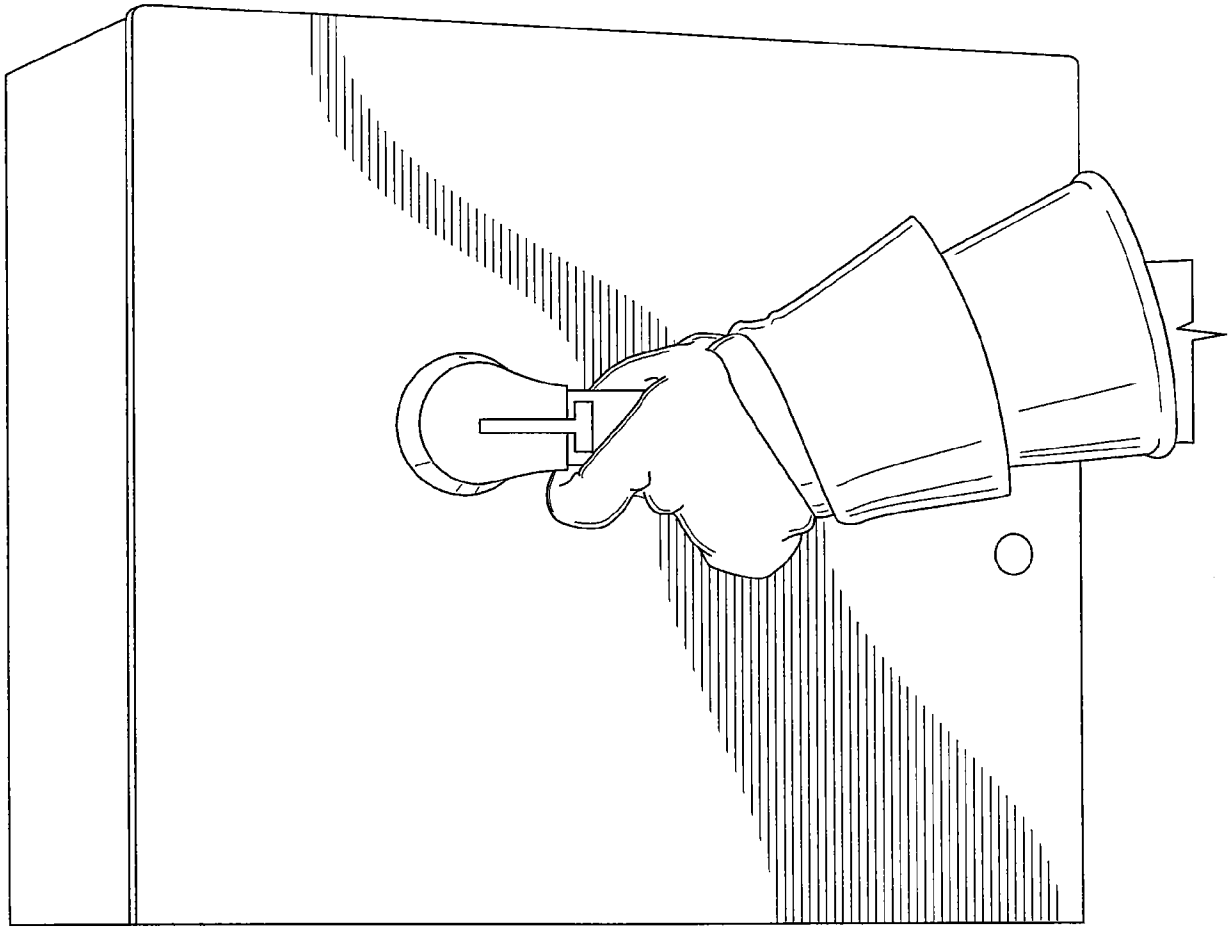
FIG. 1 (PRIOR ART)
FIG. 1 is a front view of a prior art disconnect operating handle.

The present invention now will be described more fully hereinafter with reference to the accompanying drawings, in which illustrative embodiments of the invention are shown. Like numbers refer to like elements and different embodiments of like elements can be designated using a different number of superscript indicator apostrophes (e.g., 10, 10', 10", 10'").

In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art. The term "Fig." is an abbreviation of the word "Figure" and each can be used interchangeably in the application (in the drawings and in the text of the specification).

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90° or at other orientations) and the spatially relative descriptors used herein interpreted accordingly.

The term "about" refers to numbers in a range of +/−20% of the noted value.

As used herein, the singular forms "a", "an" and "the" are intended to include the plural forms as well, unless expressly stated otherwise. It will be further understood that the terms "includes," "comprises," "including" and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements may be present. As used herein, the term "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of this specification and the relevant art and will not be interpreted in an idealized or overly formal sense unless expressly so defined herein.

The terms "disconnect operating handle", "disconnect operator handle", "disconnect handle" and "operating mechanism handle" are used interchangeably and refer to a user accessible handle, typically mounted on an exterior of an enclosure, that is connected to an internal disconnect operator (also interchangeable called an "operator mechanism") and are used interchangeably. The disconnect operator or operating handle refer to a handle connected to an assembly for opening and closing separable main contacts in a circuit breaker or for turning power ON and OFF using a switch associated with a fuse. The circuit breaker can be for a motor starter unit or feeder unit, for example.

The term "Tagout and Lockout" refers to a padlocked or otherwise external lock applied to the disconnect operator handle to physically lock the circuit breaker using a lock such as a padlock in a visually apparent manner to comply with safety guidelines, such as National Fire Protection Association (NFPA) standards 70 National Electrical Code (NFPA70E).

The terms "bucket assembly", bucket" and "unit" are used interchangeably and refer to a structure (typically a protective metal shell) that contains either a fuse or a circuit breaker for turning power ON and OFF to a motor, or feeder circuit, typically for controlling power to motor starters. As is well known, the bucket can be, for example, a feeder unit or a starter unit. The bucket assembly can include other components such as a power transformer, a motor starter to control a single motor and PLCs (programmable logic controllers), drives and the like. The bucket assembly can be configured as a modular device to allow the internal components to be assembled as a unit that can be easily installed into a Motor Control Center (MCC) compartment. As is well known, the bucket can have "power stabs" in the back that connect to vertical bus bars that carry power (current) to the compartments of a vertical section in an MCC cabinet. The vertical bus bars are connected to the larger horizontal bus bars that bring power to the vertical sections. The horizontal bus bars are usually in the top, but some MCC designs may have them in the center or bottom. The MCCs usually have a wire way for wires to the motors and other loads and control wires.

MCCs can be configured in many ways. Each compartment can have a different height to accept different frame sizes of respective bucket assemblies or units, typically in about 6-inch increments. The vertical bus can be omitted or not run through the full height of the section to accommodate deeper buckets for larger items like variable frequency drives. The MCC can be a modular cabinet system for powering and controlling motors or feeder circuits. Several may be powered from main switchgear which, in turn, gets its power from a transformer attached to the incoming line from the power company.

A typical MCC cabinet is an enclosure with a number of small doors arranged in rows and columns along the front and flat, mostly featureless, back and sides. The buckets can be provided in varying sizes. For starter units, the size can be based on the size of the motor they are controlling. The bucket assembly can be configured to be relatively easily removable for repair, service or replacement. MCCs can have, for example, regular starters, reversing starters, soft start, and variable frequency drives. MCCs can be configured so that sections can be added for expansion if needed.

The term "compact" refers to bucket units (also known as buckets) in a very condensed configuration (package) relative to conventional units/buckets. The MCC structure or cabinet 100 (FIG. 16) can be designed to receive multiple bucket units 100*u* (FIGS. 15A, 15B) ranging in various defined sizes. The units 10 can be provided in package or frame sizes of about 6 inches to about 72 inches (tall) with substantially common depth and width dimensions, known as 1× (6 inches) to 12× (72 inches) sizes. The sizes can be in single X increments, from 1X, 2X, 3X, 4X, 5X, 6X, 7X, 8X, 9X, 10X, 11X and 12X. Thus, a 5X MCC unit 10 can be about 30 inches tall. The frame sizes can be provided for a plurality of amperages, including a plurality of: 125 A, 150 A, 225 A, 250 A, 400 A, 600 A, 1200 A and 2000 A, for example. The disconnect operator handles may also be used for larger MCC units and/or non-modular designs.

Figure 2A:
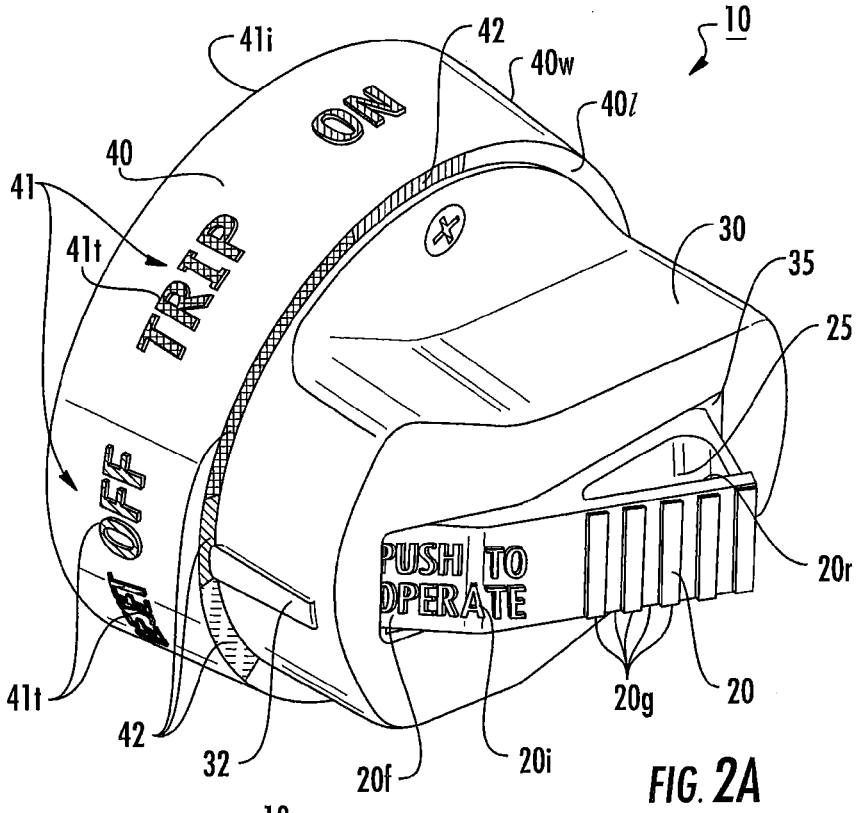
FIG. 2A is an enlarged front perspective view of an exemplary disconnect operating handle in an "OFF" position according to embodiments of the present invention.
Figure 2B:
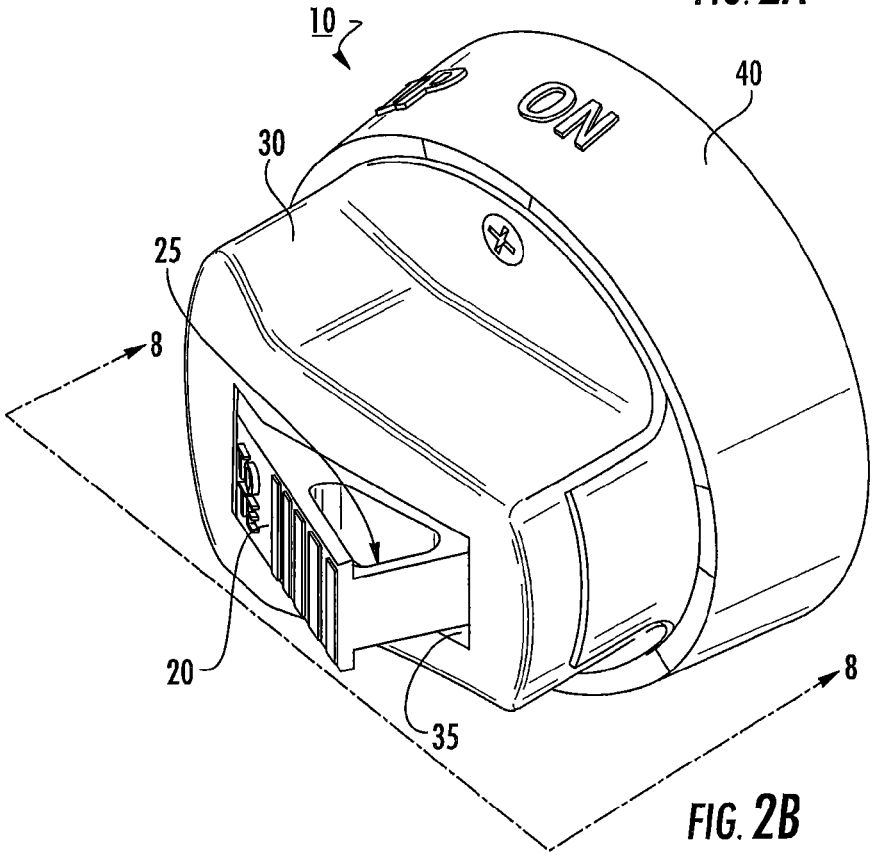
FIG. 2B is an enlarged side perspective view of the disconnect operating handle shown in FIG. 2A, again shown in the "OFF" position.
Figure 2C:
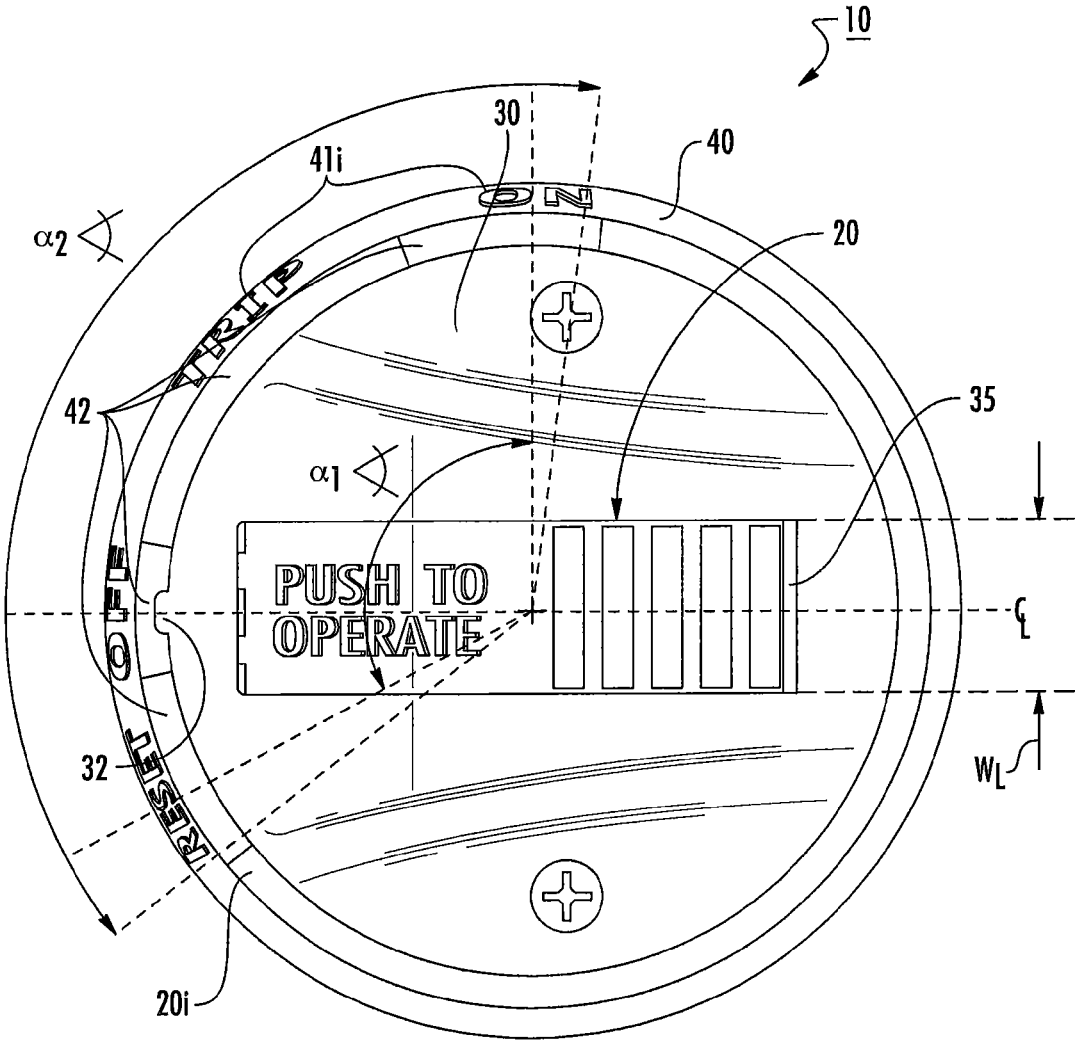
FIG. 2C is an enlarged front view of the disconnect operating handle shown in FIG. 2A, again shown in the "OFF" position.

Referring now to the figures, FIGS. 2A-2C illustrate exemplary embodiments of a disconnect operator handle 10. The disconnect operator handle 10 includes a cover 30, a lockout lever 20, and a base 40. The lockout lever 20 is pivotably held at a location between its end portions to allow each end to be able to pivot inward and outward with respect to an outer surface of the cover 30. The cover 30 has an elongate aperture or channel 35 that allows the lever 20 to pivot such that the rear end portion 20*r* projects outward a sufficient distance to expose the lockout passage 25 (e.g., padlock portal) in response to a one-click and/or a one finger push against the lever 20. The lockout passage 25 can be held under an outer closed surface of the lever, inside a closed or substantially closed perimeter space sized and configured to allow a locking arm, cable or other lock configuration to extend therethrough to hold the lock in position with sufficient structural rigidity to perform the lock functionality. As shown, the lock passage 25 is bounded by two long sides that taper out from a front end to attach to a shorter end cross-segment, but other shapes may be used.

The lever 20 is configured to facilitate ease of operation of a user so as to be able to operate the handle 10 in one gloved hand and padlock the handle with the other hand or single-handedly. The handle 10 has an interlock configuration that allows the user to press the raised lockout lever 20 inward over the rear end portion of the lever 20*r* (on the right side of the pivot, away from the front end portion 20*f*) before the handle 10 can be rotated from OFF to ON, for example, in normal operation. Once out of the lock orientation with the base 40, the base has a closed surface at the radial distance associated with the interlock or "lockout" pin 65 so that is retains the lever end 65*e* above the base, thereby compressing the resilient member 60 and keeping the lever 20 in a configuration with the lock passage 25 inside the handle 10 (under the cover 30).

The handle 10 can have an optional feature that a site may desire, typically provided as field or site-installation customer modification option, where a user must also press the raised lockout lever 20 before the handle can be rotated from ON to OFF. This optional feature can be provided using a knockout 40*k* in the base 40 (FIG. 11) to provide a respective aperture for this optional function. This is atypical but may be desired for some site with safety/operational concern for important or critical loads.

The cover and lever 30, 20, rotate together with respect to the base 40 over a defined angular rotation between different operational positions of ON, TRIP, OFF and, optionally, also RESET. The handle 10 can have position detents for providing tactile feedback to the user for all three handle operating positions, ON, OFF and TRIP.

Figure 3:
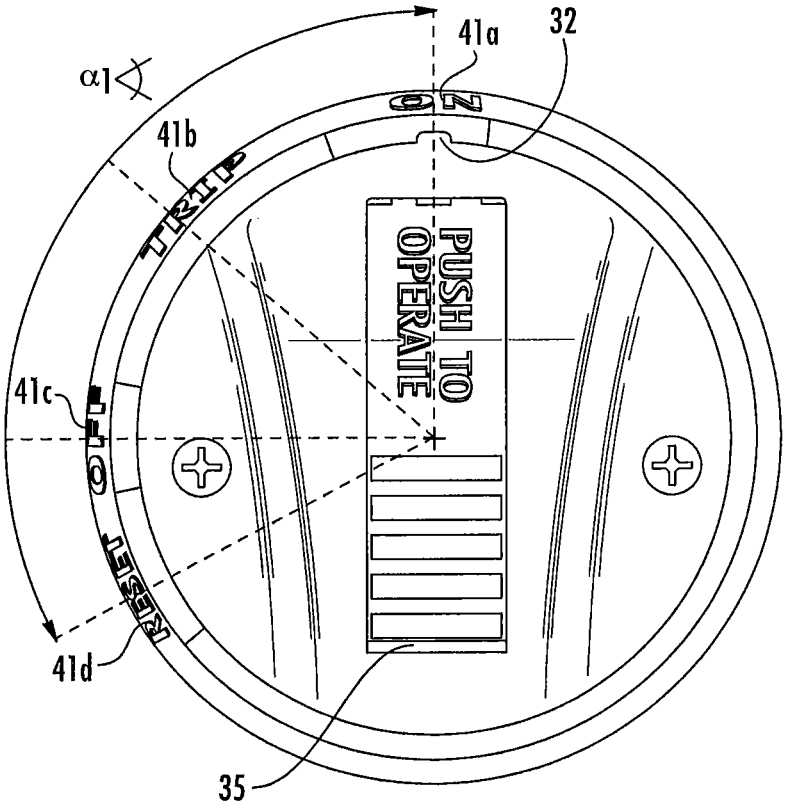
FIG. 3 is an enlarged front perspective view of the disconnect operating handle shown in FIG. 2A, in the "ON" position according to embodiments of the present invention.

FIGS. 2C and 3 illustrate that the handle 10 can be configured to allow the cover 30 and lever 20 to rotate between about 90-120 degrees over a full operational status range between the operational positions. Typically, the operational stops for each of the positions is at a medial location of the color-coded segments 42, 41*i* associated with angle noted as $\alpha_1$, measured with respect to the center of the cover 30. However, the lever and cover may rotate over the full range noted by each segment to the second angle, $\alpha_2$. ON and RESET may be at the two respective end positions. The TRIP position may occupy the largest angular perimeter space than the others and OFF may occupy the smallest perimeter space, and associated largest and smallest travel between neighboring operational positions.

The visual indicia 41*i* and 42 for the ON position can be in red, for the TRIP position may be in yellow, for the OFF position may be in green and for the RESET position may be in white. FIG. 2A indicates shading/cross-hatching of the text and ledge of the base 40 that can include corresponding colors for visual indicia of operating condition/status to a user. While the shading/cross-hatching is not shown in certain of the other figures, the handles 10 shown may include similar color-coded visual indicia. Also, other defined color schemes may also be used. Where text is used, it may be provided in a language appropriate for the use of the circuit breaker, e.g., in English and one or more non-English languages.

Figure 9A:
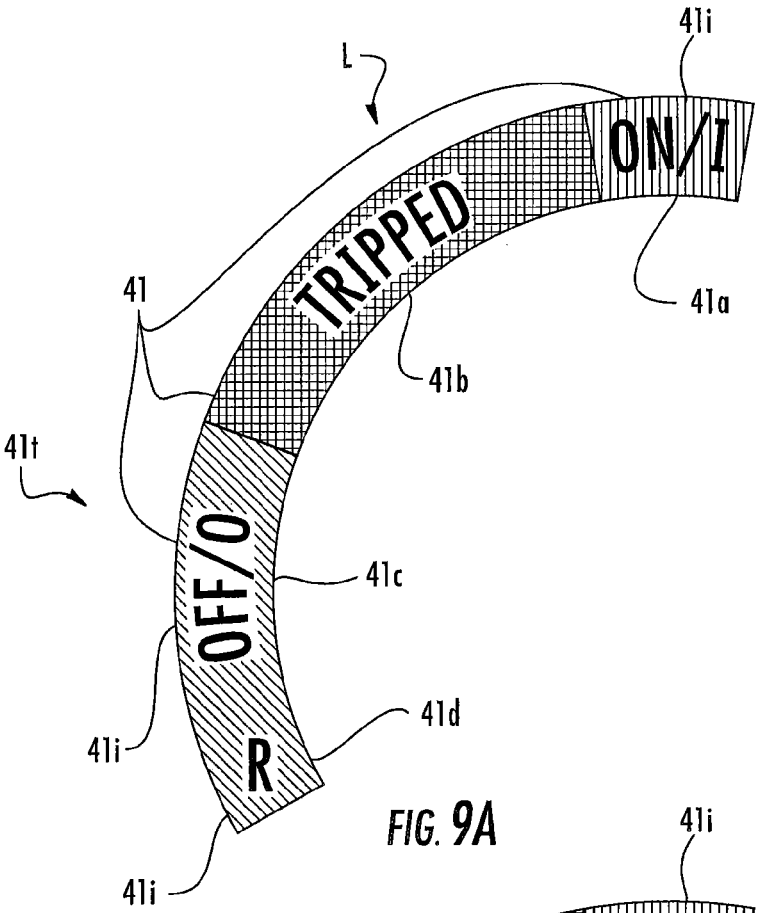
FIG. 9A is an example of alternate visual indicia to indicate operational status of the handle position according to embodiments of the present invention.
Figure 9B:
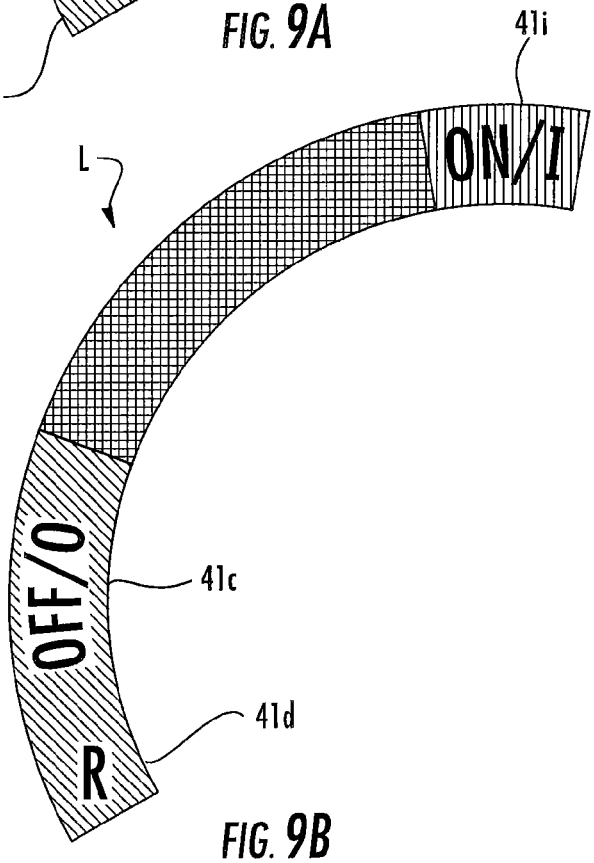
FIG. 9B is another example of visual indicia that can be used to indicate operational status of the handle position when the handle is used with a fuse/disconnect switch according to some embodiments of the present invention.
Figure 15A:
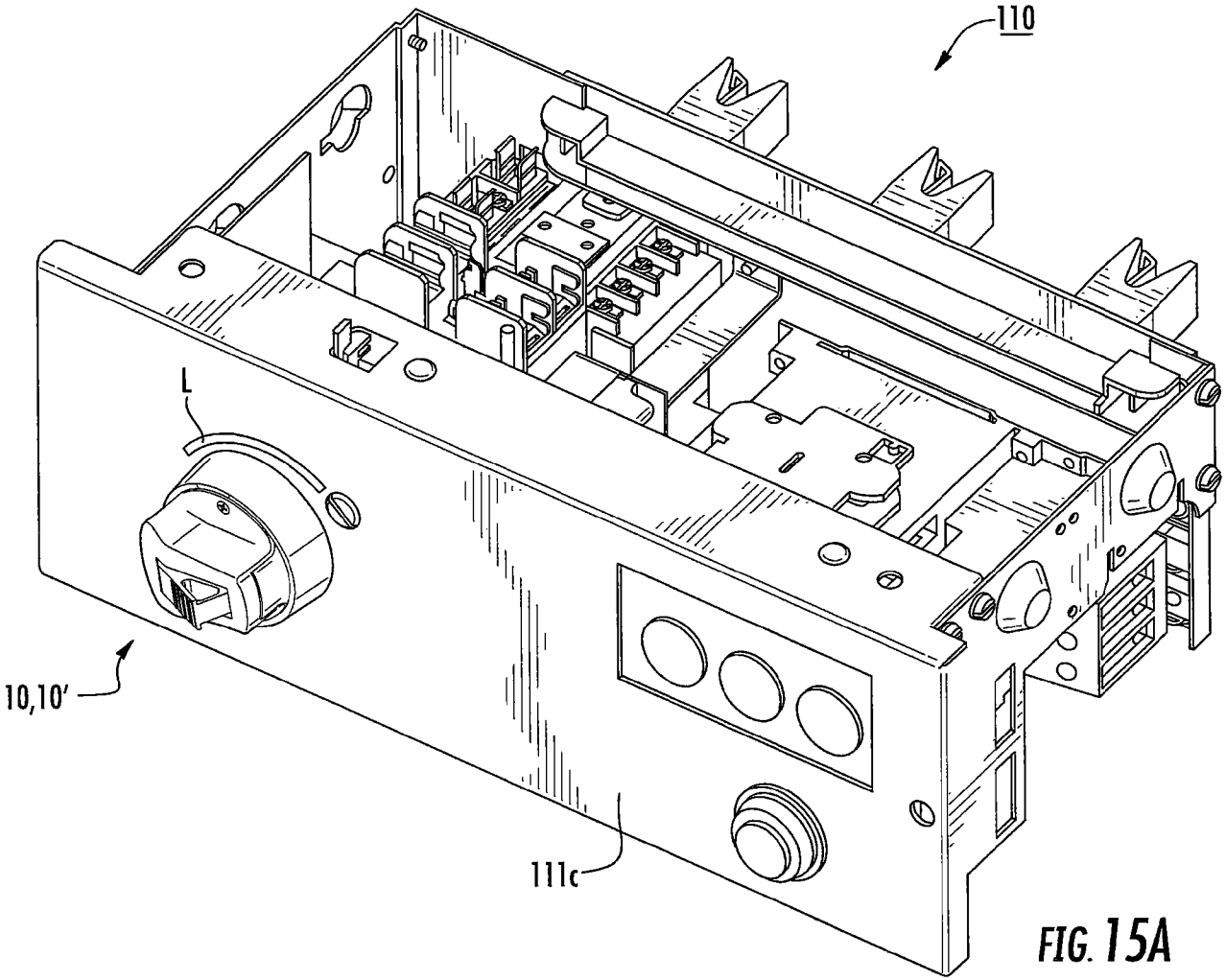
FIG. 15A is a front perspective, partial cutaway view of an exemplary bucket assembly or MCC unit according to embodiments of the present invention.

FIG. 9A illustrates an alternate text that may be used for indicating operation positions for the wall 40*w* of the handle 10 and/or may be placed as a separate label L appended to a front cover 111*c* of a unit 110 adjacent the handle 10 (FIG. 15A, for example). FIG. 9B illustrates another alternate text arrangement that may be used to indicate operational positions for the wall 40*w* and/or used as a label L for front cover 111*c* of a unit 110. This embodiment may be particularly suitable for a fuse/disconnect switch (which does not have a TRIP position). The color indicia (e.g., yellow) of the TRIP position may be included or excluded).

The text 41*t* where used can be provided in multiple concurrent different languages on the handle 10. The base 40 may be in a contrasting or different color such as dark grey or black. The operational positions may be indicated with different colors than those indicated. The cover 30 can be in yet a different color from the base 40 and the indicia 41*i*, 42. In some embodiments, the cover 30 may be provided in blue. The cover 30 can be provided in more than one color depending on application or target end use.

The cover 30 can have a projection 32 that resides in front to the lever 20 and aligns with the various operational positions to indicate status of the circuit breaker.

The lever 20 can have two operational configurations with respect to the cover 30: a first configuration where the entire lever 20 is substantially (or totally) flush with the upper surface of the cover or slightly recessed in the cover channel 35; and a second configuration, where the front end portion 20*f* of the lever pivots inward a small distance into the cover 30, and the opposing end portion 20*r* pivots outward to expose the lock passage 25.

The lever 20 can be configured so that the rear end 20*r* automatically "pops" out and/or projects out of the cover channel 35 when the lever 20 is depressed (pressed inward) by a user. The rear end of the lever 20*r* with the lock passage 25 can be held in the cover 30 and biased to project or pivot outward when a user presses against the lever 20 at a location that is left of the pivot (spaced apart from the rear end portion 20*r*), typically at a medial to front end portion 20*f* of the lever. Although not shown, the handle 10 may also alternatively be configured in the reverse, e.g., so that the front end portion of the lever "pops" out by reversing the configuration of the underlying components.

The lever 20 can include visual indicia 20*i* of one or more icons and/or text providing user input on how to operate the lever, e.g., "push to operate", "press to operate", "press to rotate", "press to turn on", "lock" and "unlock" and the like. This indicator 20*i* can reside on a front end to medial portion of the lever 20 as shown. The rear end portion of the lever 20*r* may optionally have ribs or surface features 20*g*, shown as having alternating parallel channels and valleys, for facilitating user contact grip and/or increased sliding friction.

Figure 17A:
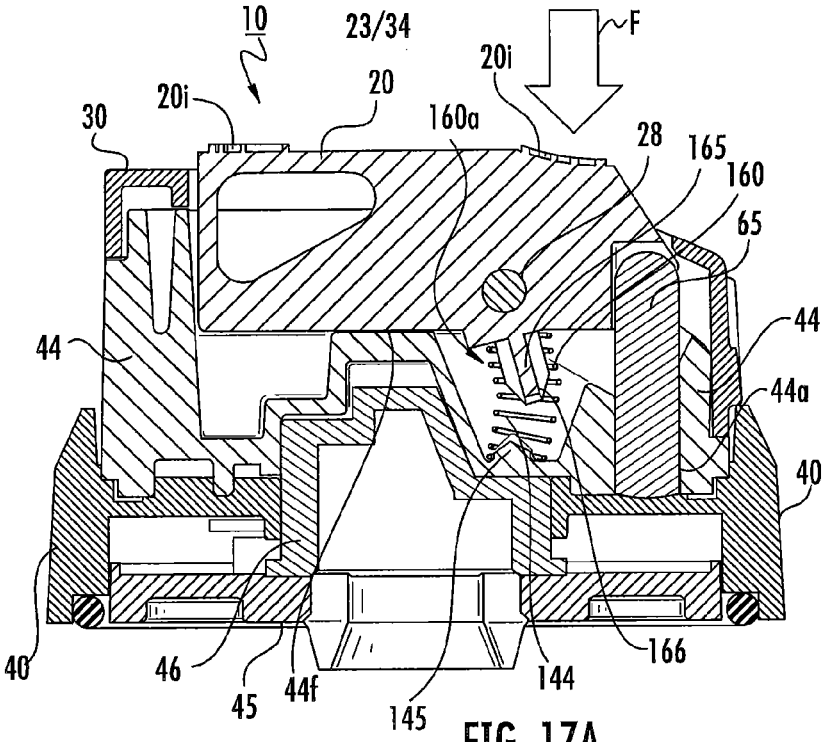
FIG. 17A is a section view showing another embodiment of a handle with a handle interlock illustrating an interconnect pin disengaged and the lever in a non-padlock (non-extended) configuration according to embodiments of the present invention.
Figure 17B:
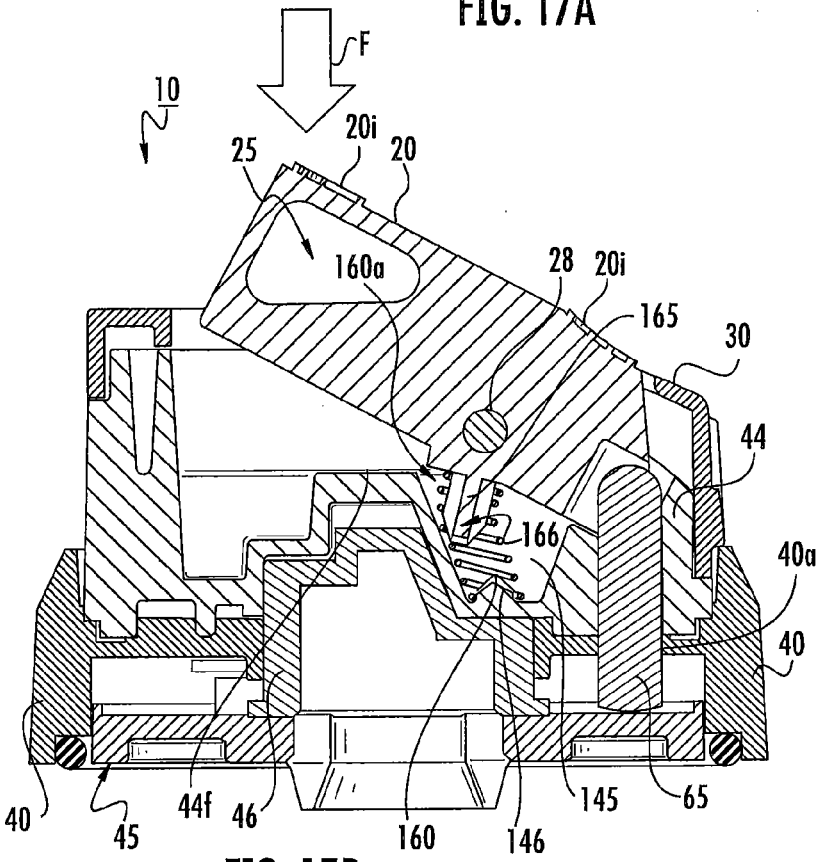
FIG. 17B illustrates the device shown in FIG. 17A but with the padlock portal extended and the interlock pin engaged according to embodiments of the present invention.
Figure 19A:
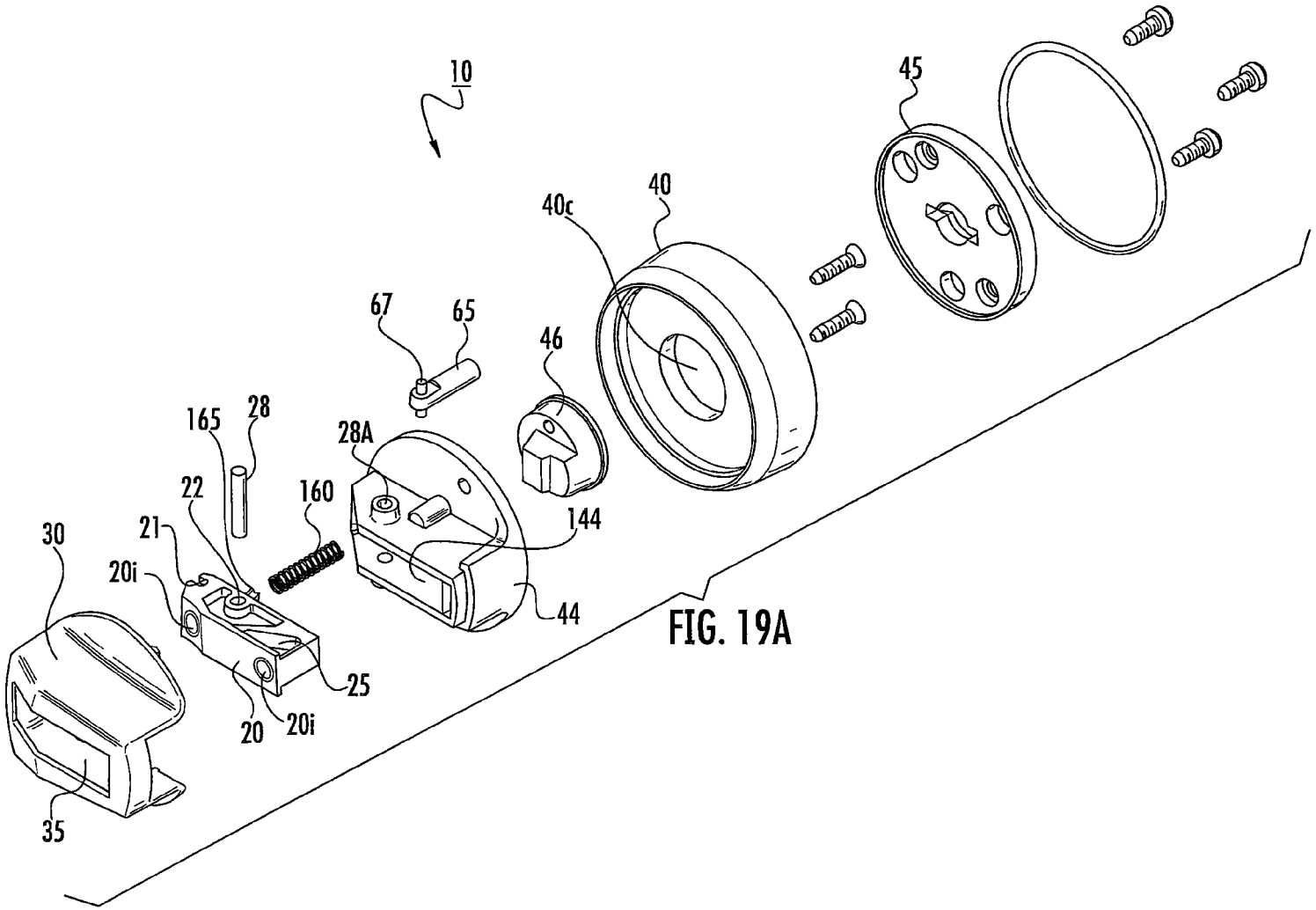
FIG. 19A is an exploded view of the disconnect operating handle assembly shown in FIGS. 17A and 17B according to embodiments of the present invention.
Figure 19B:
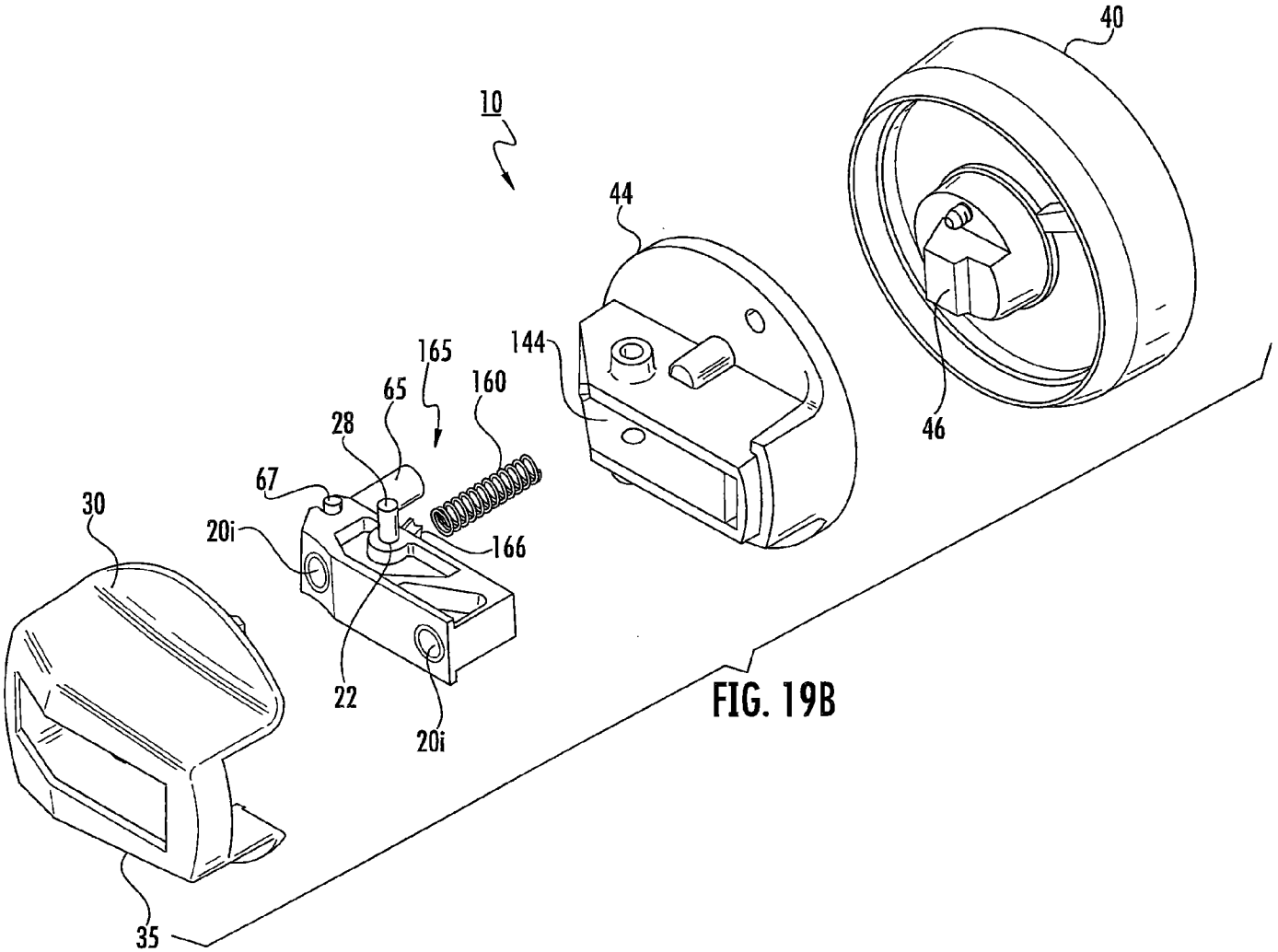
FIG. 19B is an exploded, partial assembly view of the exemplary disconnect operating handle shown in FIG. 19A according to embodiments of the present invention.

In some embodiments as shown in FIGS. 17A, 17B and 19B, molded icons 20*i* representing a lock in a locked and unlocked configuration can be on an outer surface of the lever 20. Typically, the "locked" icon at the front end portion and the "unlocked" icon at the rear to indicate where a user should press against the lever to cause the lever to return to the closed position or to open to expose the padlock (pressing against the front icon).

The base 40 can include a wall 40*w* with visual indicia 41*i* of operational position of the handle 10 with respect to the circuit breaker. The visual indicia 41*i* can include text or icons representing each operational position of the circuit breaker, e.g., ON, TRIP, OFF, RESET. The visual indicia 41*i* can be in different colors with different text representing each position. The base can include a ledge 40*l* with corresponding color coded segments 42 representing the respective operational position and/or the aligned positional text 41*t*.

Figure 2D:
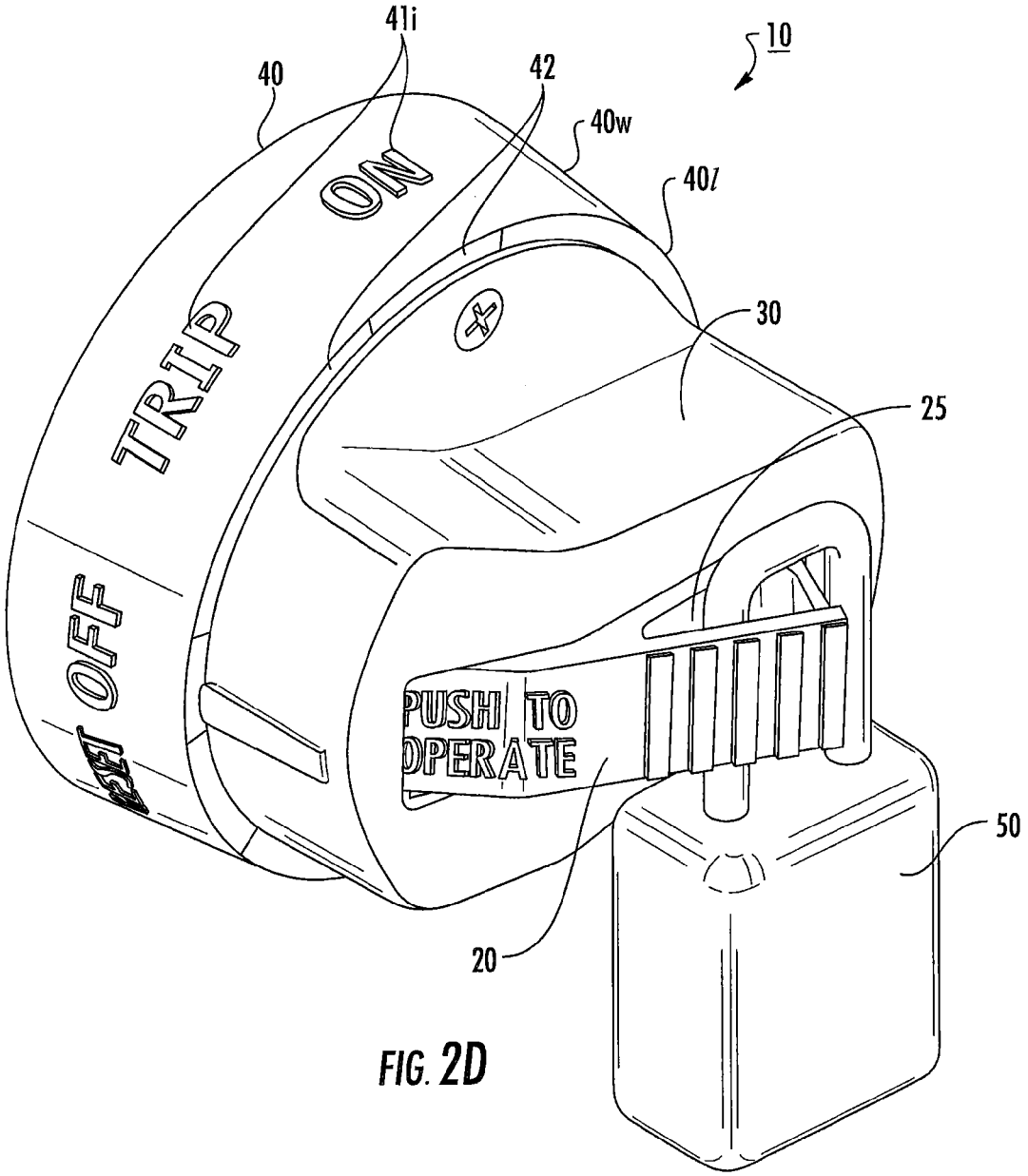
FIG. 2D is an enlarged front perspective view of the disconnect operating handle as shown in FIG. 2A, in the "OFF" position and with a lock in a "Lockout and Tagout" configuration.
Figure 2E:
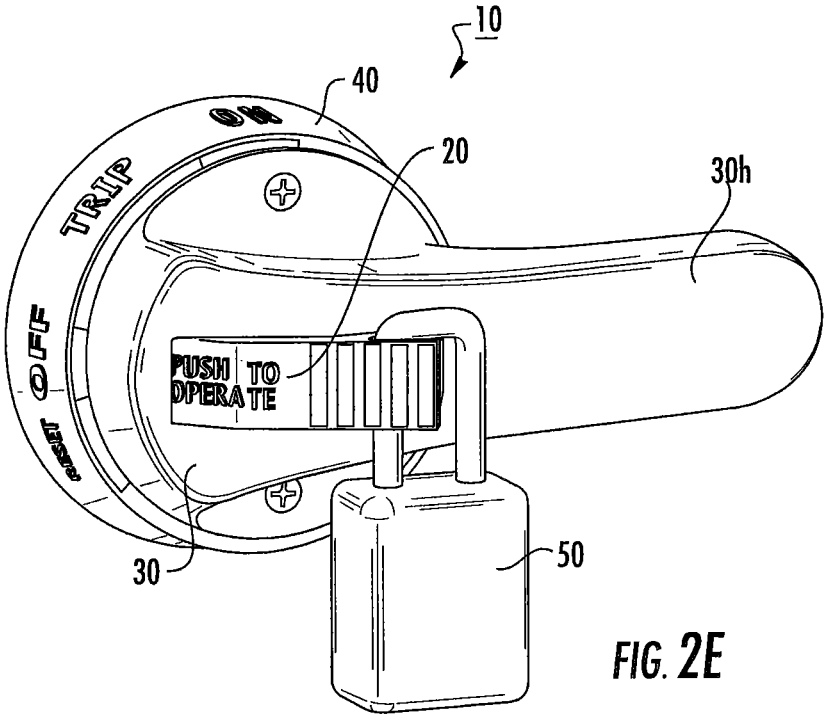
FIG. 2E is an enlarged front perspective view of a longer handle version of the disconnect operating handle shown in FIG. 2A, shown in the "OFF" position and with a lock in a "Lockout and Tagout" configuration.

FIGS. 2D and 2E illustrate an exemplary Tagout and Lockout configuration with a padlock locked to the handle, extending through the lock passage 25 of the lever 20, when the handle 10 is in the OFF position. Other suitable physical locks may also be used. FIGS. 2A-E illustrate the handle 10 in the OFF position with the lever longitudinal centerline (C/L, FIG. 2C) aligned with this position 42 and with the cover nose 32 also aligned with this position.

FIG. 2E also illustrates that the cover 30 can include an elongate user grab handle 30*h* that may be suitable for disconnects using a larger operating torque for switching the internal disconnect operator and/or for grab handle for facilitating insertion or withdrawing an MCC unit from a structure such as a cabinet. The grab handle 30*h* can be provided in various lengths. The cover can include a grab handle 30*h* that is configured as a dual handle with a symmetrically positioned in line handle extending off the other side of the cover 30 (not shown).

Figure 4:
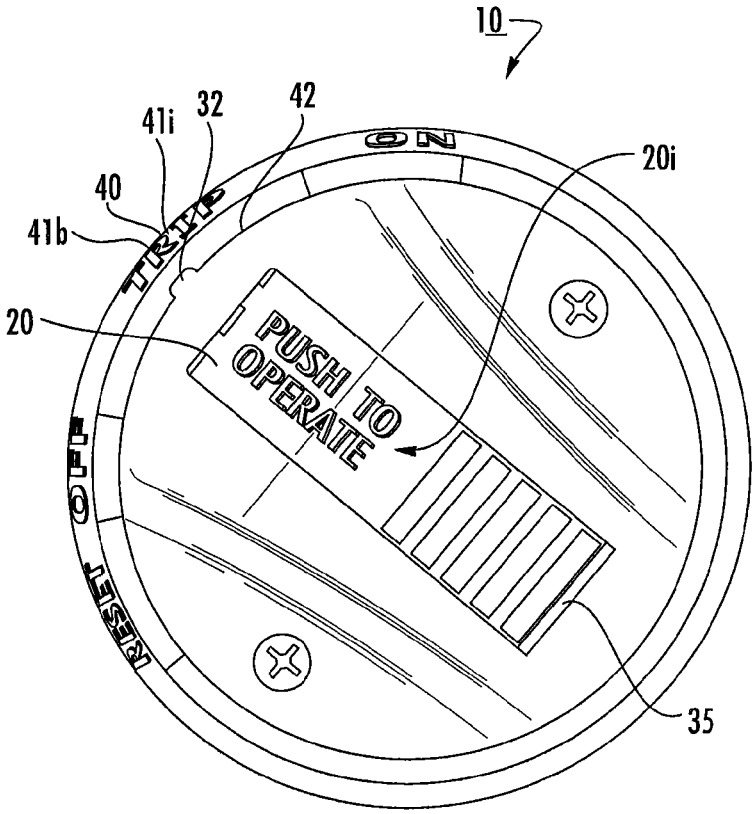
FIG. 4 is an enlarged front perspective view of the disconnect operating handle shown in FIG. 2A, in the "TRIP" position according to embodiments of the present invention.
Figure 5:
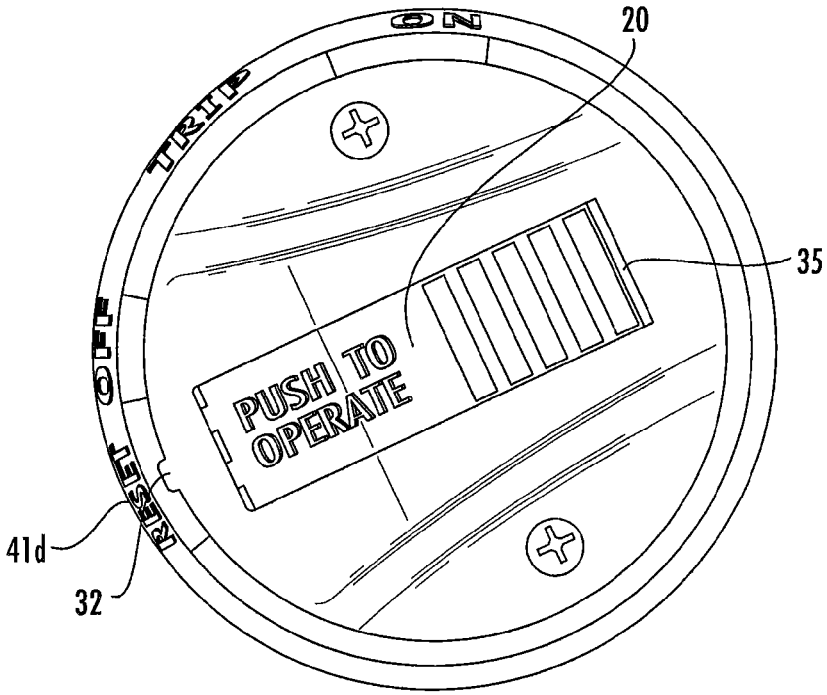
FIG. 5 is an enlarged front perspective view of the disconnect operating handle shown in FIG. 2A, in the "RESET" position according to embodiments of the present invention.

FIG. 3 illustrates the handle in the ON position and labels the operational positions of ON, TRIP, OFF and Reset as position segments 41*a*, 41*b*, 41*c*, 41*d*, respectively. FIG. 4 illustrates the handle 10 in the TRIP position 41*b* while FIG. 5 illustrates the handle 10 in the RESET position 41*d*.

Figure 6:
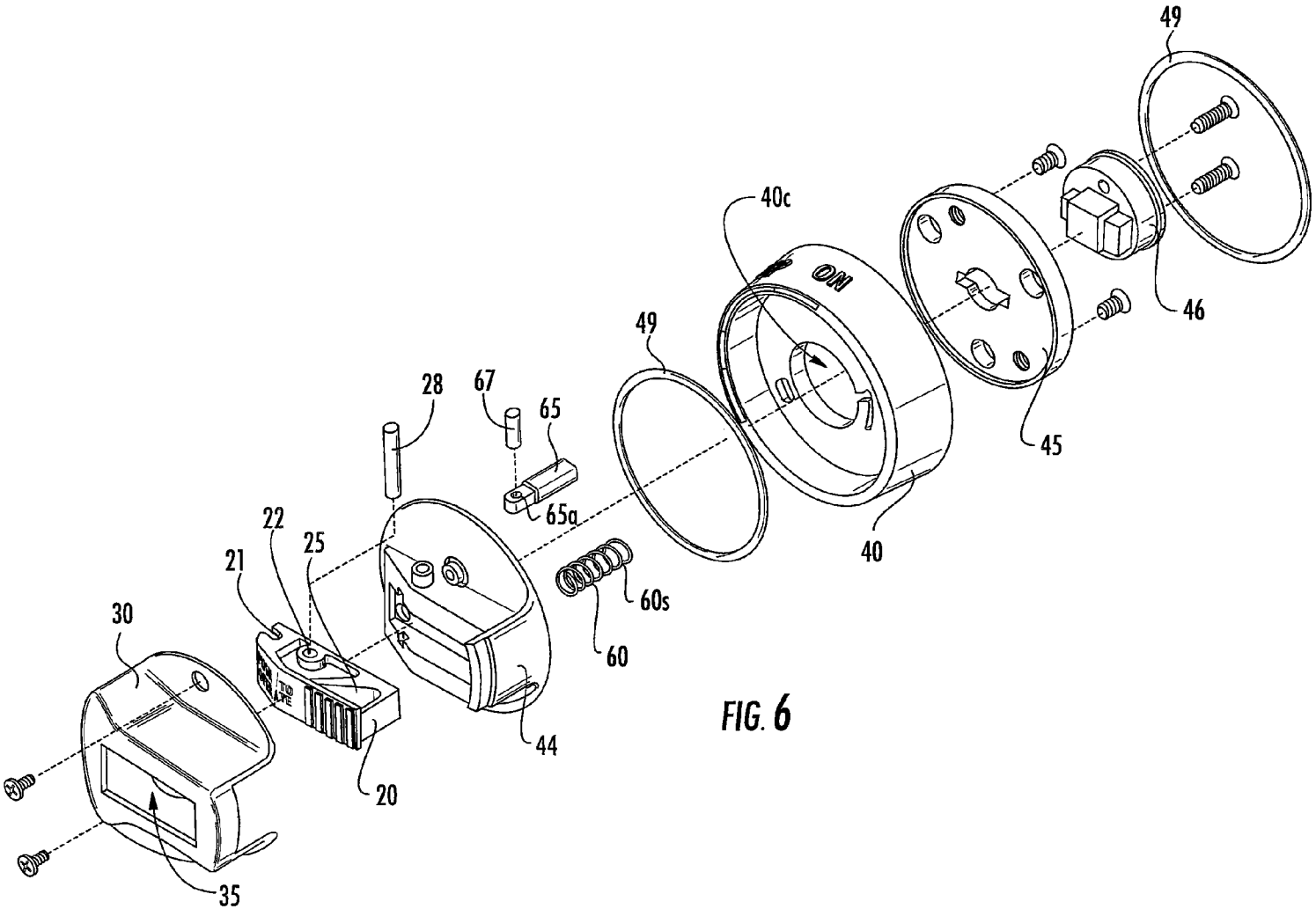
FIG. 6 is an exploded view of an exemplary disconnect operating handle assembly according to embodiments of the present invention.
Figure 7:
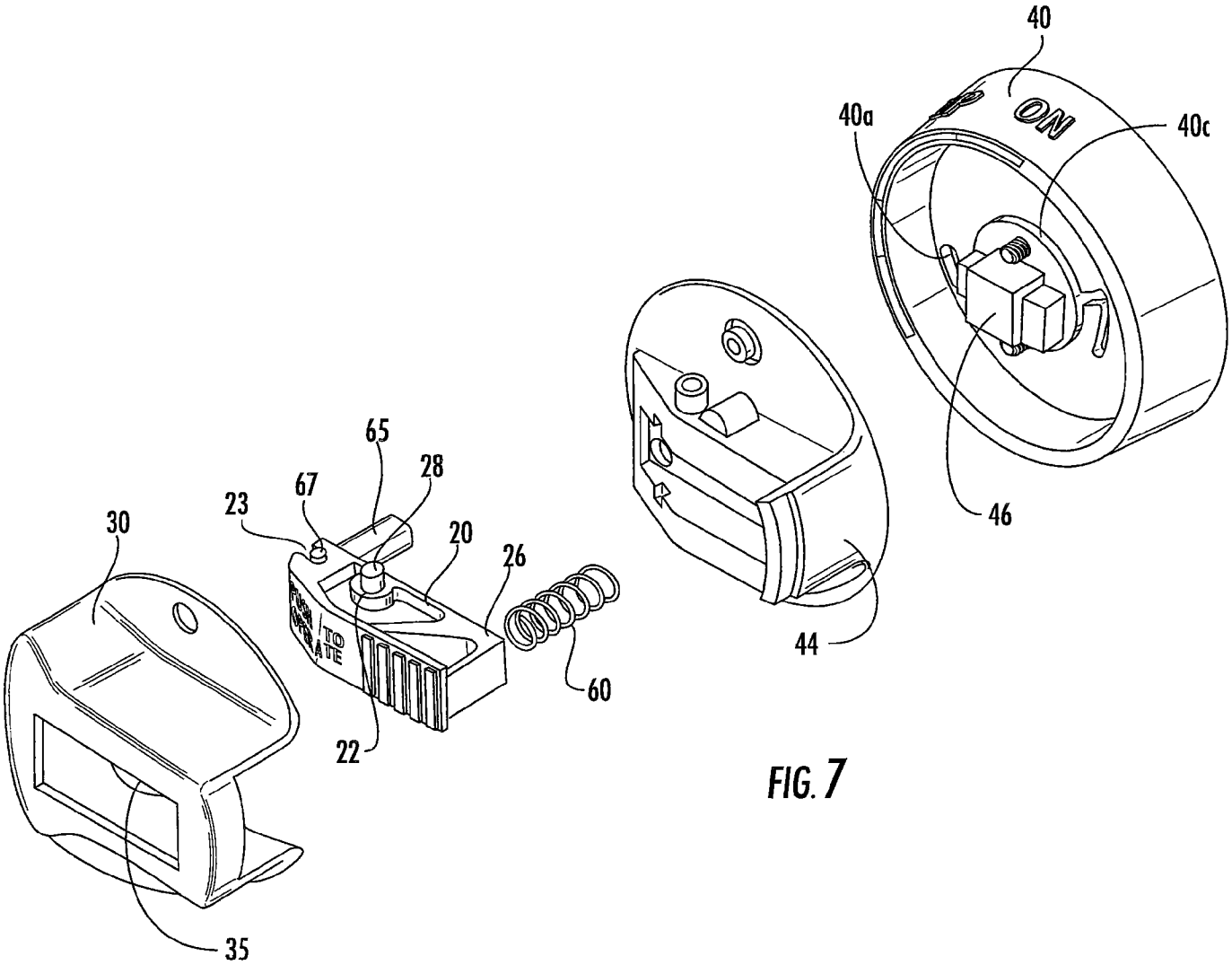
FIG. 7 is an exploded, partial assembly view of the exemplary disconnect operating handle shown in FIG. 6 according to embodiments of the present invention.
Figure 8A:
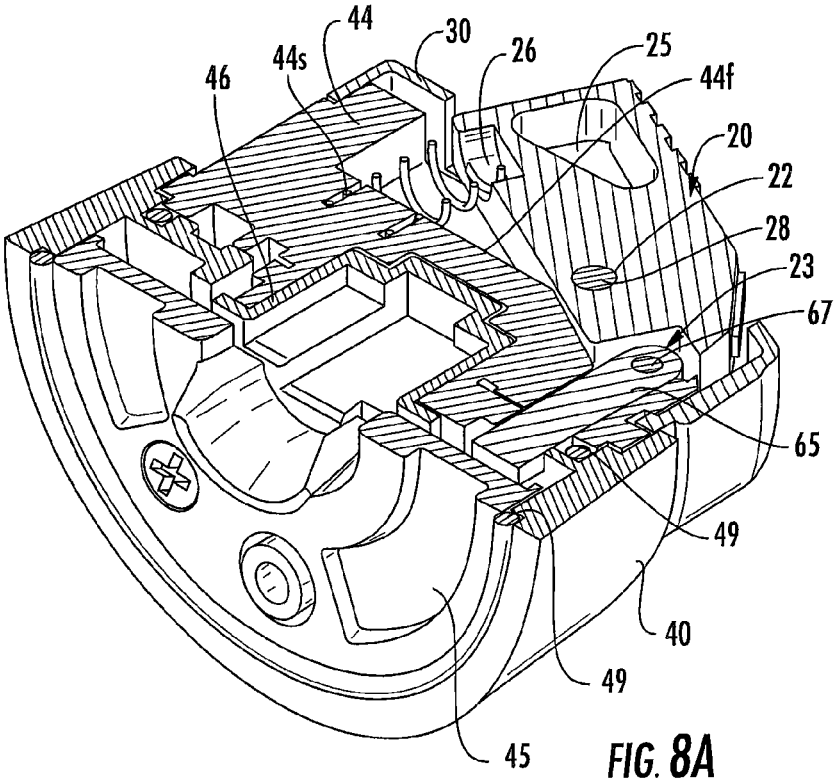
FIGS. 8A-8C are section views of the disconnect operating handle shown in FIG. 2A, taken along plane 8-8 in FIG. 2A.
Figure 11:
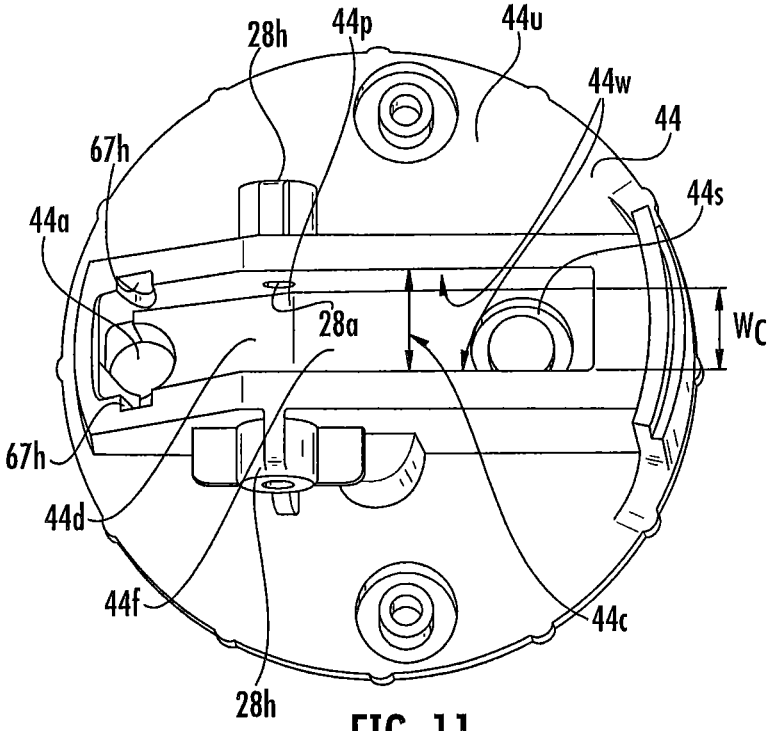
FIG. 11 is a greatly enlarged top/front view of the handle core according to embodiments of the present invention.

FIG. 6 is an exploded view of the handle 10 according to some embodiments of the present invention. The handle 10 includes the cover 30, lockout lever 20 and base 40 discussed above. The handle 10 can also include a handle core 44. The handle core 44 can be configured to cooperate with the cover 30 to hold the lever 20 using the lever pivot pin 28. The lever 20*f* includes a laterally extending channel 22 that resides between the front and rear end portions 20*f*, 20*r*, respectively of the lever 20, typically closer to the front end portion of the lever. As shown, the outer ends of the lever pivot pin 28 are held by the handle core in apertures 28*a* (FIG. 11). However, it is contemplated that the lever 20 can be pivotably held using other configurations including attached directly to the cover. As shown in FIGS. 6, 7 and 8A, for example, the pivot pin 28 can reside in a transverse channel 22 at a medial location of the lever body between the front and rear end portions 20*f*, 20*r* (rear of the interlock pin 65), typically spaced closer to the front end portion 20*f* but spaced to reside behind the front edge so that the front end portion 20*f* can pivot up and down into the channel of the cover 35 a distance which is less than the pivotable movement of the rear end portion of the lever 20*r* between operative positions, lock out and non-lock out.

FIG. 6 also illustrates that the handle 10 has at least one lockout interlock or lockout pin 65 and an interlock retainer pin 67. The interlock retainer pin 67 can be sized and configured to extend through an aperture 65*a* in the lockout interlock pin 65. As is shown in FIG. 7, when assembled, the front end portion 20*f* of the lever 20 holds the interlock retainer pin 67 and interlock pin 65. The front end portion of the lever 20*f* can include a transverse cavity 21 and a downwardly facing cavity 23. The downwardly facing cavity 23 (FIGS. 8A-8C) holds the lockout interlock pin 65 so that the pin 65 extends inwardly toward the base 40 with the retainer pin 67 extending through the transverse cavity 21, orthogonal to the interlock pin 65. Although shown as a single interlock pin 65, multiple pins may be used. For example, two side by side lockout interlock pins 65 can be attached to the lever 20 and the retainer pin 67 (not shown) and allowed to pivot up and down in concert to engage the lockout pin with the base 40 and release the lockout pin from the base 40. The interlock pin 65 can be any suitable shape including polygonal, cylindrical, triangulated and the like.

FIG. 6 also illustrates that the handle 10 can include at least one resilient member 60, shown as a coil spring 60*s*, that, in some embodiments, can be configured to push the rear end portion of the lever 20*r* out when the lever 20 is depressed by a user. As shown in FIGS. 7, 8A-8C, the resilient member 60 resides in a gap space 26 in a lower portion of the rear end portion 20*r* of the lever and the other end extends to reside aligned with the gap space 26 in the lever. The handle core 44 may optionally include a channel 44*s* aligned with the gaps space 26 to hold the resilient member in proper alignment. The resilient member 60 can be configured to elastically deform to provide the suitable spring force to operate the lever. The resilient member 60 can be configured as one or more of a flexible solid or hollow elastic plug, O-rings, stacked dome or spring washers, Belleville washers and the like and combinations of the above or other resilient (e.g., elastic) members. For embodiments comprising the coil spring 60*s*, the channel 44*s* and/or lever 20 can be configured to hold the coil 60*s* and may optionally have a thin cylindrical shape surrounding a wall (shown as a solid center) to hold the resilient member in position.

Figure 15B:
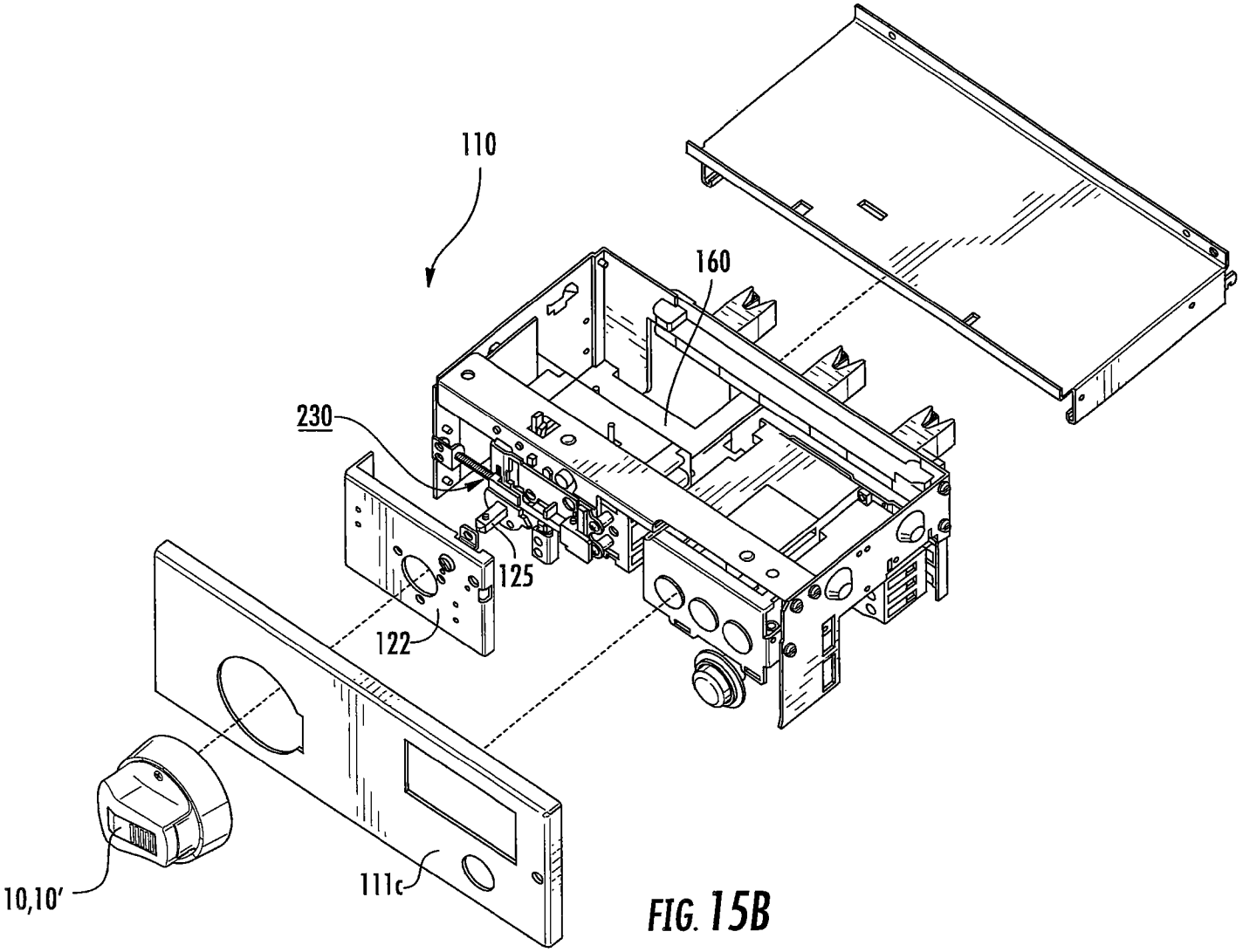
FIG. 15B is a partial exploded view of the unit shown in FIG. 15A illustrating the shaft that connects the operating handle to the internal disconnect operator according to embodiments of the present invention.

Referring again to FIG. 6, the handle 10 may include an inner cover 45 that fits on a bottom or back surface of the base 40 and a drive shaft holder 46. The drive shaft holder 46 holds the shaft 125 in channel 46*ch*. The shaft 125 connects to the operator mechanism 230 (FIG. 15B). Although shown in FIG. 6 as in back of the cover 45, the drive shaft holder 46 fits between the cover and the base as shown in FIG. 7.

Referring to FIG. 7, the drive shaft holder 46 an extend outward through the center channel 40*c* of the base 40 a sufficient distance to engage the handle core 44 so as to be able to rotate with the cover, lever and core, 30, 20, 40, respectively (when not locked) while the base is stationary (e.g., the base does not rotate).

Figure 8B:
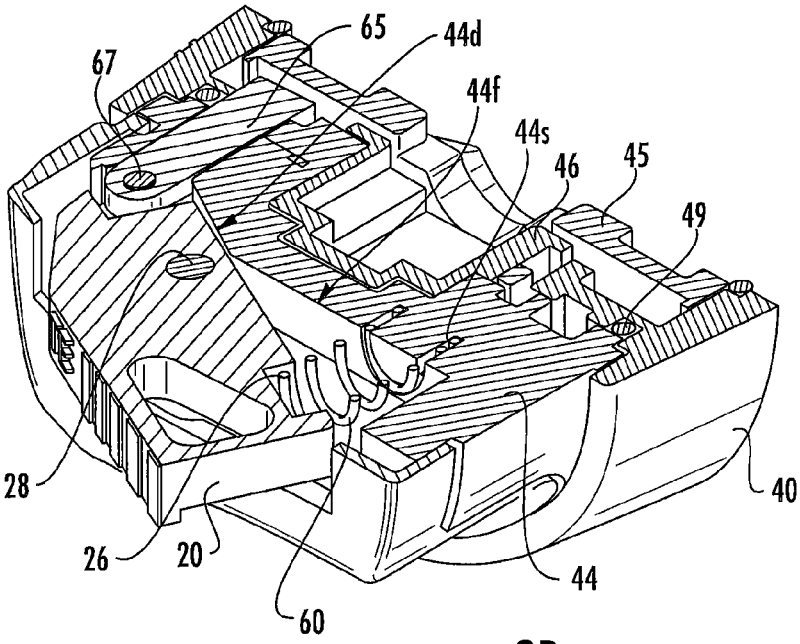
Figure 8C:
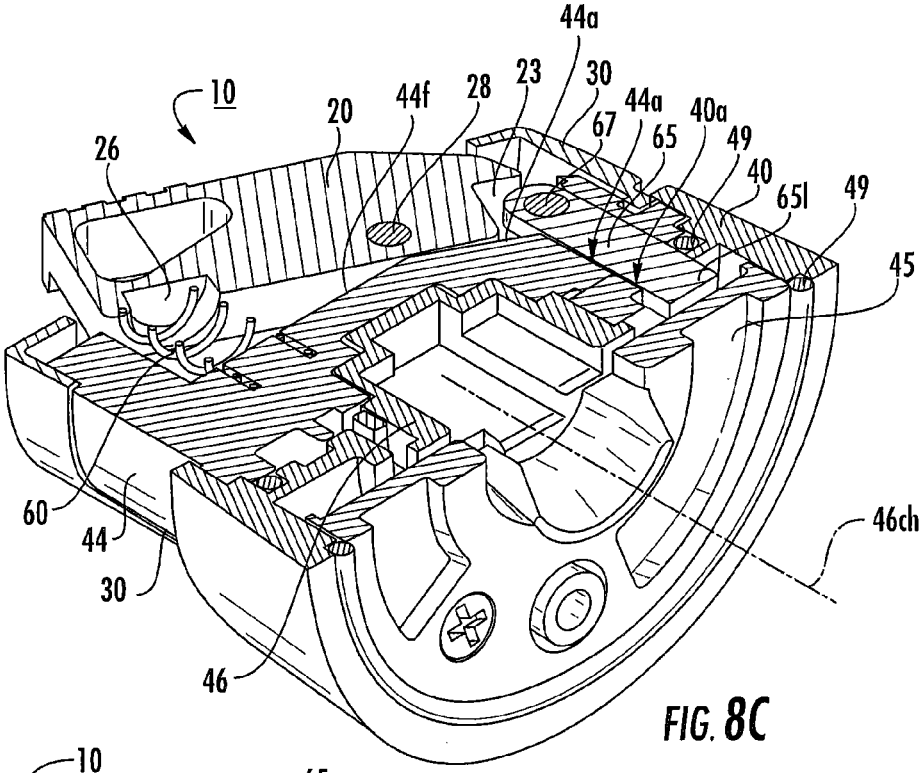

FIG. 6 shows that the handle 10 may also include O-rings that can allow a tight seal of the assembled components, typically one between the handle core 44 and the base 40 and another between the cover 45 and rear of the base 40 as shown in FIGS. 8A-8C.

FIGS. 8A-8C illustrate the lever raised and the resilient member 60 uncompressed with the lockout interlock pin 65 extended down to prevent the core 44 from rotating relative to the base 40.

Figure 8D:
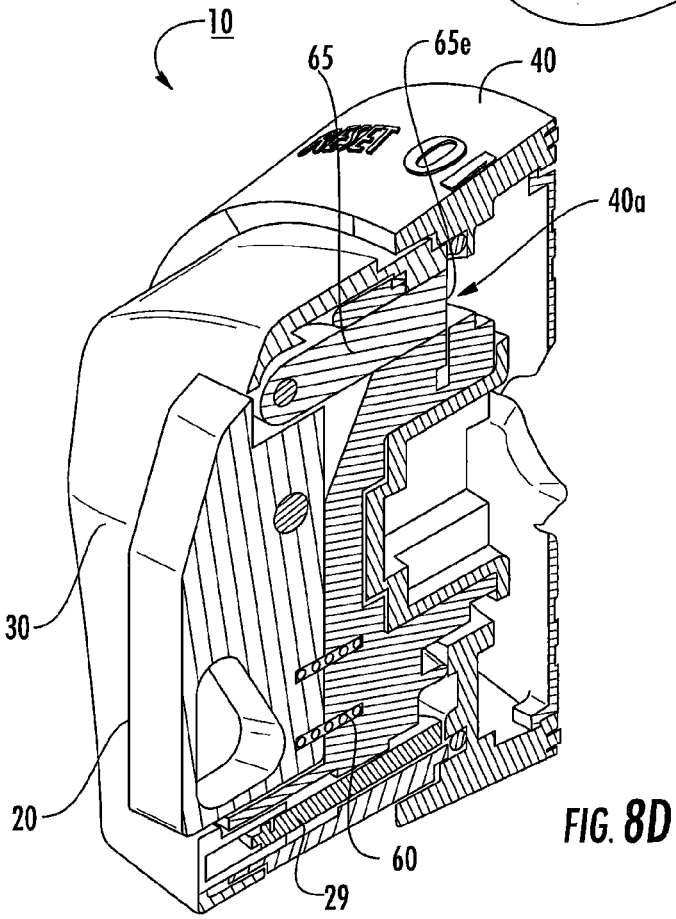
FIG. 8D is a section view showing the interconnect pin disengaged and the lever in a non-padlock (unextended) configuration according to embodiments of the present invention.

FIG. 8D illustrates the lever retracted with the resilient member 60 compressed and the interlock pin 65 moved up (actually moved outward in an operational configuration) a distance sufficient to allow the cover 30, lever 20 and core 44 to move together as a unit relative to the base 40.

Figure 10:
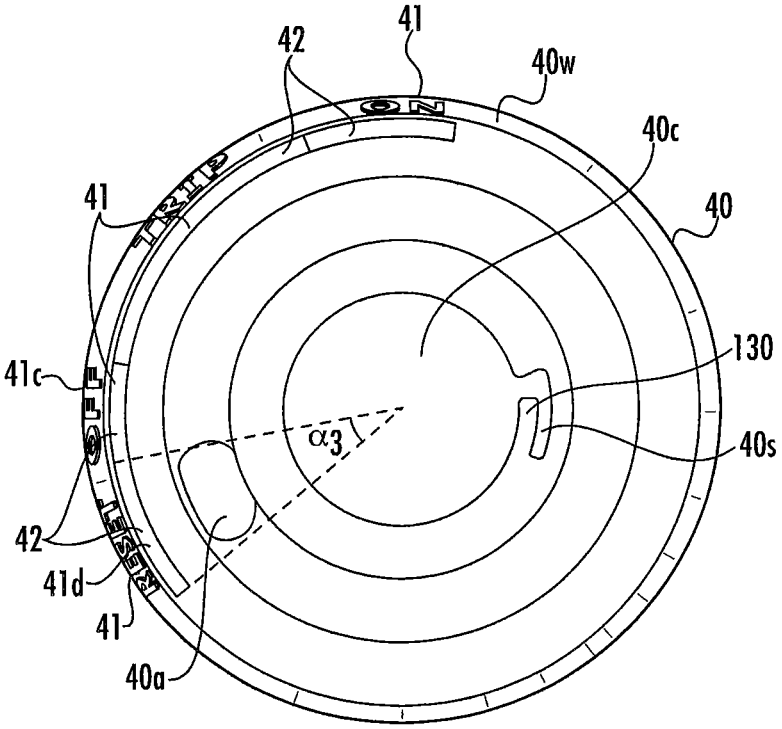
FIG. 10 is a greatly enlarged front view of an example of a base of the disconnect operating handle according to embodiments of the present invention.

FIG. 10 is an enlarged view of an exemplary base 40. The base includes a through aperture 40*a* that allows the lower end portion 65*l* of the at least one retainer pin 65 to extend down toward the cover 45 and lock the handle from rotation from the operational position.

The core 44 can have an aperture 44*a* as shown in FIG. 11 that aligns with the base aperture 40*a* to allow the lower end of the at least one retainer pin 65 to extend down into a lock configuration as shown, for example in FIG. 8C. The aperture 40*a* can be configured to circumferentially extend a defined distance associated with a distance of the RESET and OFF operational positions 41*c*, 41*d*. The ends of the aperture 40*a* can be curved to snugly receive the contact surface of the at least one retainer pin 65. The aperture 40*a* can extend a circumferential distance, measured from a center of the handle, to have an angle α3 that is between about 10-60 degrees, typically between about 10-45 degrees, such as about 10 degrees, about 15 degrees, about 20 degrees, about 20 degrees, about 30 degrees, about 35 degrees, about 40 degrees and about 45 degrees. The handle core aperture 44*a* can have a different shape as shown in FIG. 11, and is typically circular.

FIG. 10 also shows a curvilinear detent and/or locator feature 40*s* extending off the main center channel 40*c*. This locator feature 40*s* can comprise a circumferentially extending cantilevered arm, stub or cantilevered beam 130 that is radially spaced apart from the adjacent part of the base 40. The cantilevered stub or beam 130 can deflect up and down as it contacts surface features in different handle position locations.

Figure 12A:
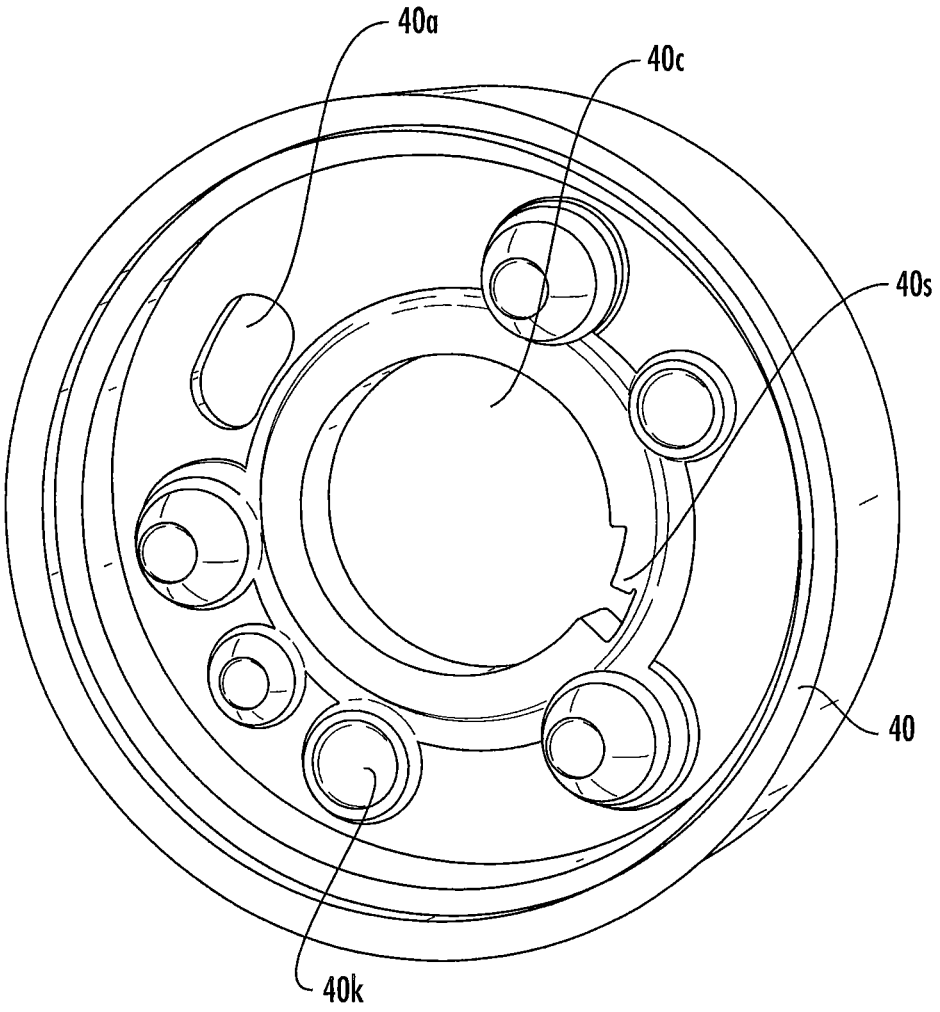
FIG. 12A is a greatly enlarged bottom view of the base of the operating handle according to embodiments of the present invention.
Figure 12B:
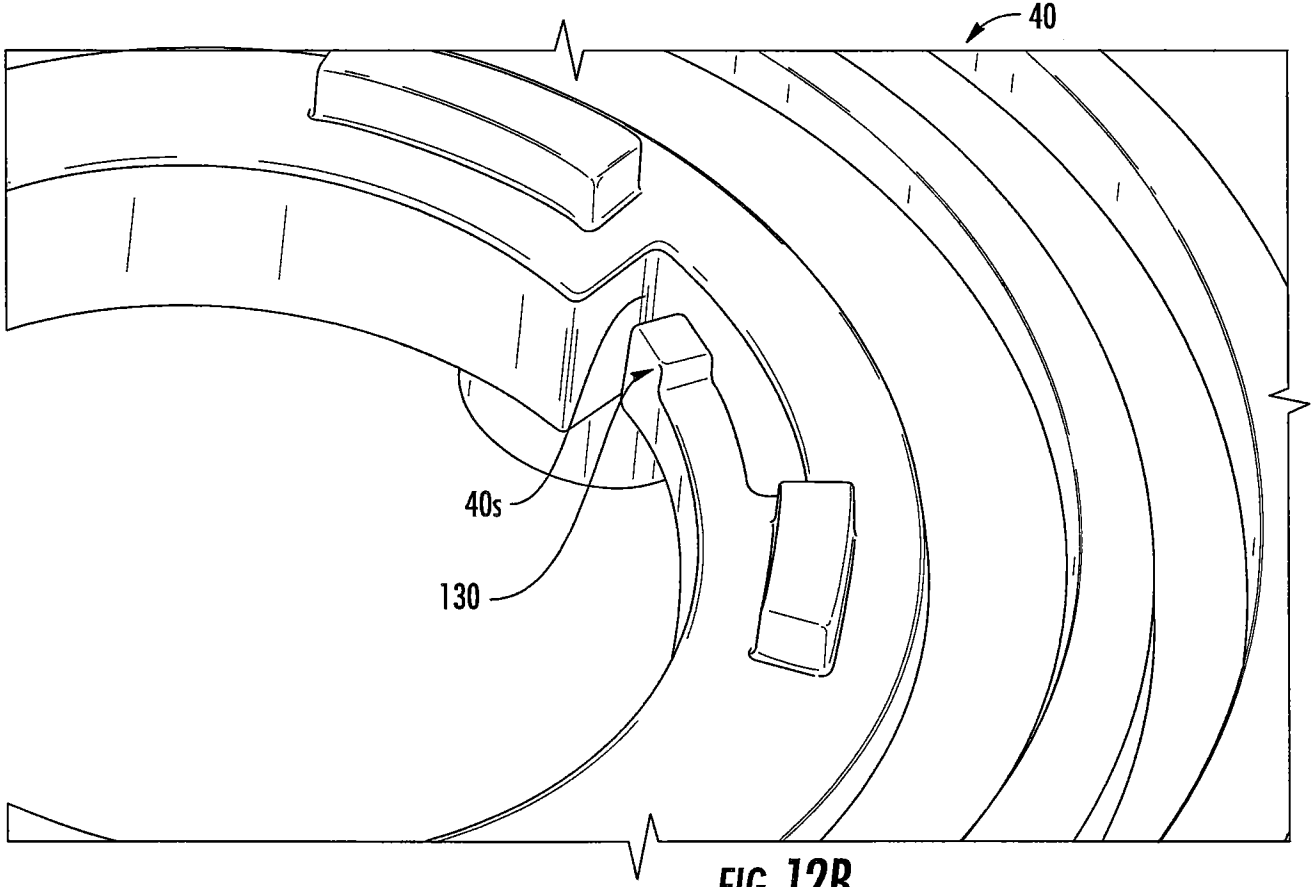
FIG. 12B is a greatly enlarged view of a portion of the base illustrating a locator feature according to embodiments of the present invention.
Figure 12C:
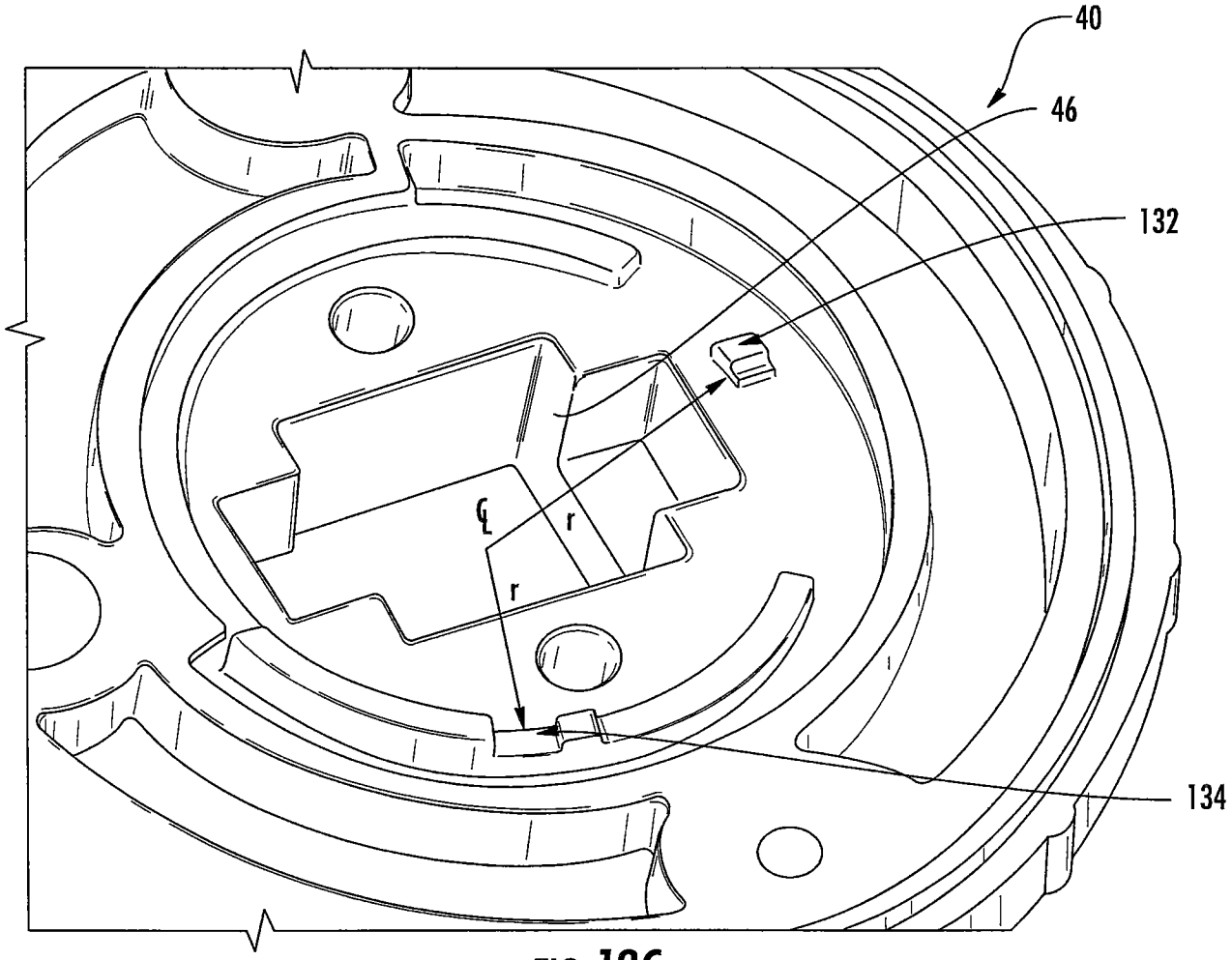
FIG. 12C is a greatly enlarged view of a portion of the base with the drive shaft holder illustrating exemplary surface features that cooperate with the locator feature of FIG. 12B for indicating handle position according to embodiments of the present invention.

FIG. 12C illustrates exemplary surface features 132, 134 at an OFF-RESET position and at an ON position, respectively, that cooperate with the locator feature 130 for providing tactile feedback of handle position and/or to help direct the handle to reside in a desired position according to embodiments of the present invention. The ON locator feature 134 can comprise a recess while the circumferentially spaced apart OFF-RESET locator feature 132 can comprise a projection. There can be a circumferentially extending ramp that extends between the two features 132, 134.

Figure 12D:
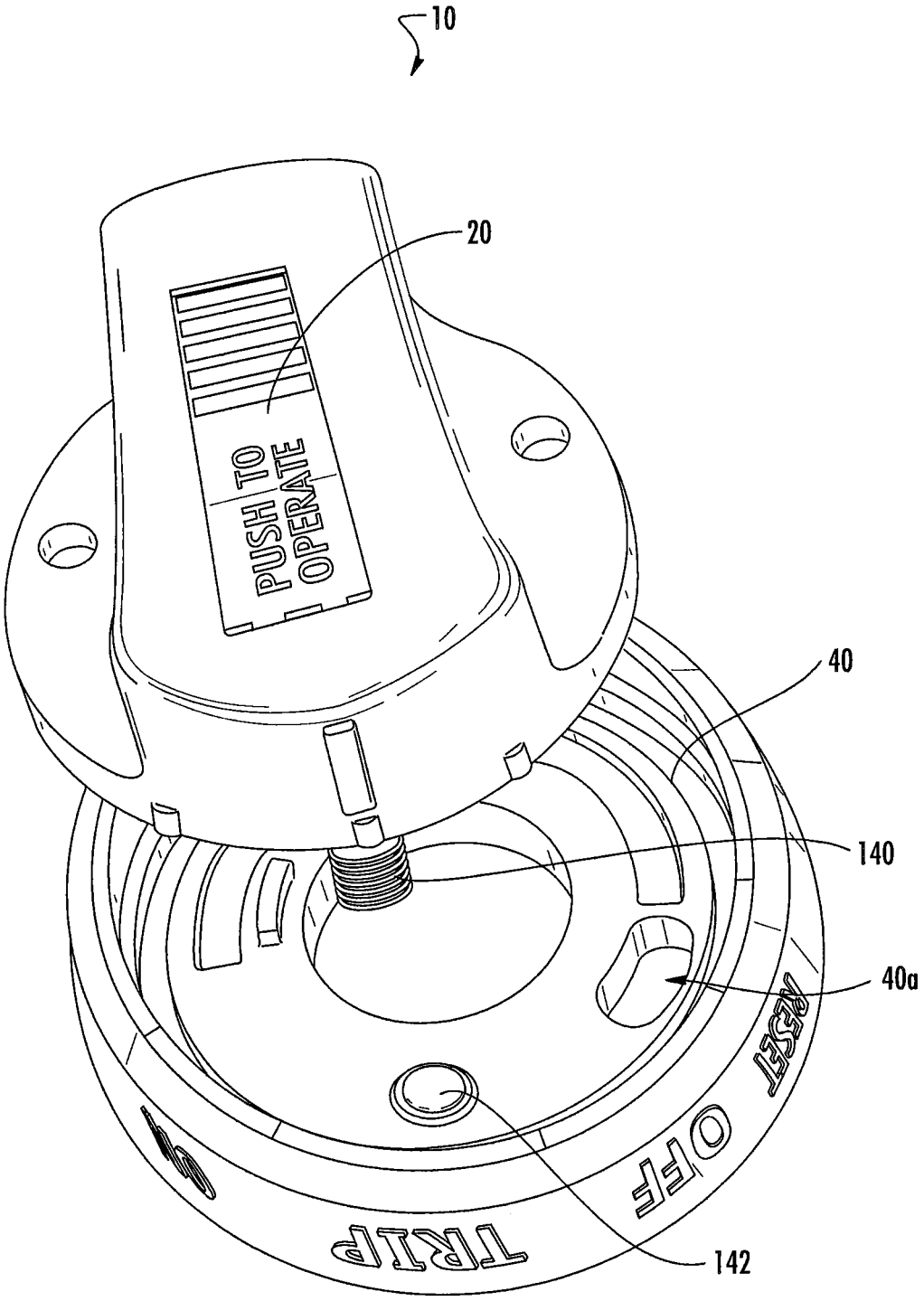
FIG. 12D is a partially exploded view of an operator handle with a tactile position feedback configuration using a spring-loaded plunger and cooperating surface feature(s) in the base according to embodiments of the present invention.

FIG. 12D is a partially exploded view of an exemplary operator handle 10 with an optional tactile position feedback configuration using a spring-loaded plunger, e.g., a downwardly (inwardly in operation) extending plunger 140 and spring 140*s* that can contact surface feature 142 on the base 40 to provide a detent configuration when the handle 10 is in the TRIP position according to some embodiments of the present invention.

FIG. 11 illustrates that the handle core 44 can have an upper surface 44*u* that faces the cover 30. The upper surface 44*u* includes a pair of spaced apart outwardly extending parallel walls 44*w* that span a channel 44*c*. The channel 44*c* is sized to receive a lower end of the lever therein and has a width Wc that is slightly larger than the width of the lever 20 ($W_L$, FIG. 2C). The walls 44*w* each include shoulders 28*h* that provides the respective pivot pin apertures 28*a* to hold the opposing ends of the pivot pin 28 (FIG. 7) therein. The upper surface 44*u* can also include retainer pin holders 67*h* which may be recesses (but can optionally be configured as shoulders similar to the pivot pin configuration or any other suitable retention configuration).

In some embodiments, the upper surface 44*u* also includes a resilient member retention feature 44*s* shown as a circular channel in the lever channel 44*c*.

The channel 44*c* can have floor that is substantially flat 44*f* (right of the pivot as shown in FIGS. 8A-8C) and a forward end portion that angles down 44*d* (forward of the pivot 28). The medial to rear end portion of the lever 20*f* can abut the lower surface of the lever when the lever is in the flat or non-lockout configuration (FIG. 8D) which can provide a suitable "stop" for the lever in this orientation. The outer surface of the handle core can thus includes a flat segment 44*f* between the walls 44*w* and a segment that angles down 44*d* toward the front end portion of the lever 20*f* and the pivot pin holders 28*h* can reside above (more outward in operative position) and adjacent a peak 44*p* that transitions the flat segment 44*f* to the angled segment 44*d*.

FIG. 12A shows an example of a base 40 with the optional knockout feature 40*k*. This knockout 40*k* can be circular. The knockout 40*k* is circumferentially spaced apart from the original aperture 40*a* to align with the ON operational position and can have a smaller size aperture.

Figure 13A:
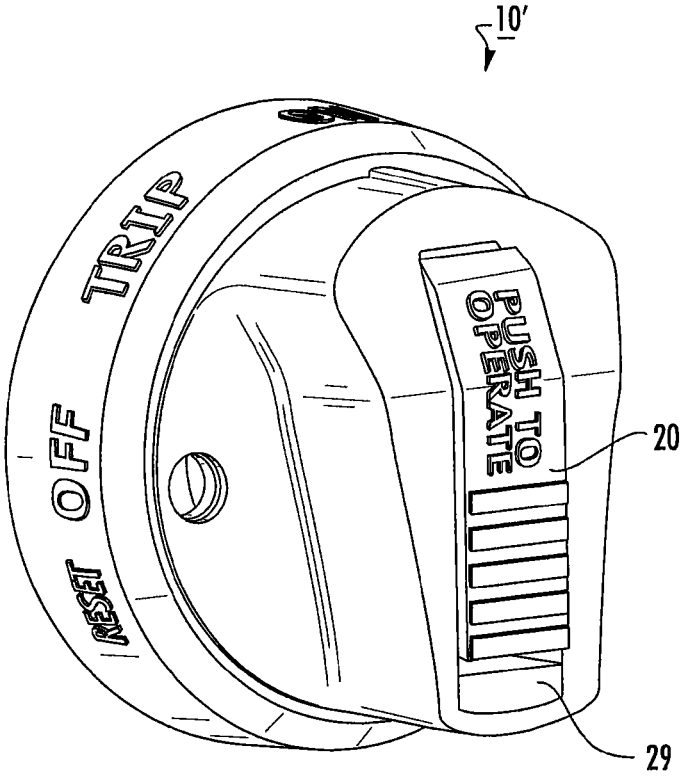
FIGS. 13A and 13B are front perspective views of an exemplary disconnect operating handle illustrating a light illuminating feature on the handle to provide an externally visible visual indication of a defined operational status or problem/condition of a circuit breaker according to embodiments of the present invention.
Figure 13B:
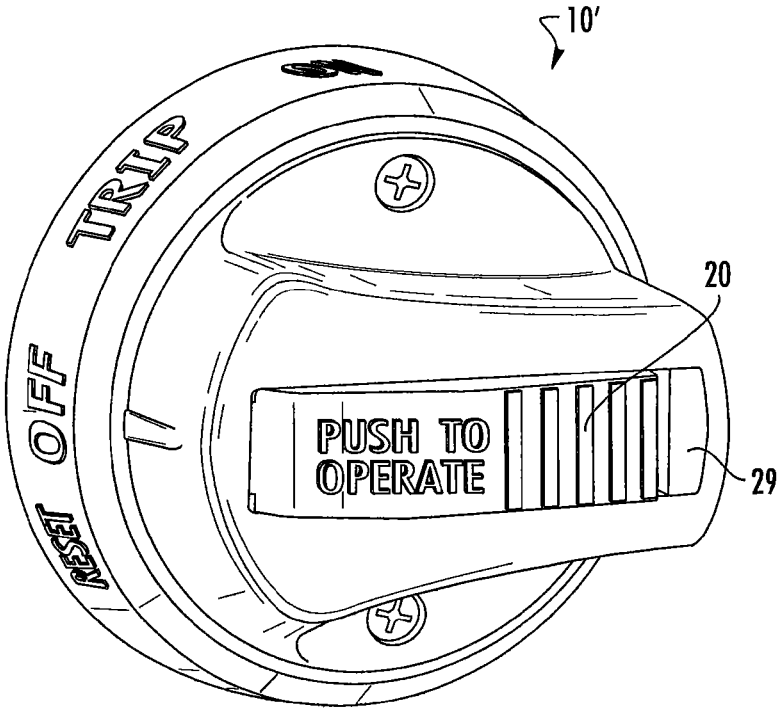
Figure 14A:
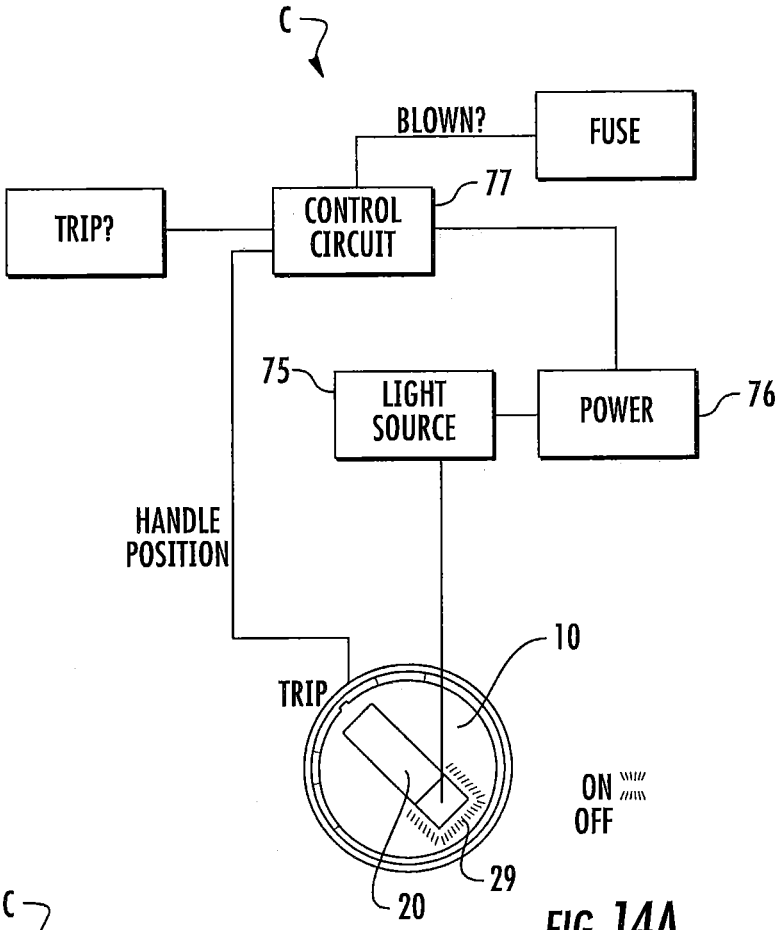
FIGS. 14A and 14B are schematic illustrations of an exemplary circuit breaker unit (onboard) circuit for powering a light source for the illumination feature shown in FIGS. 13A-13C, for example, according to embodiments of the present invention.
Figure 14B:
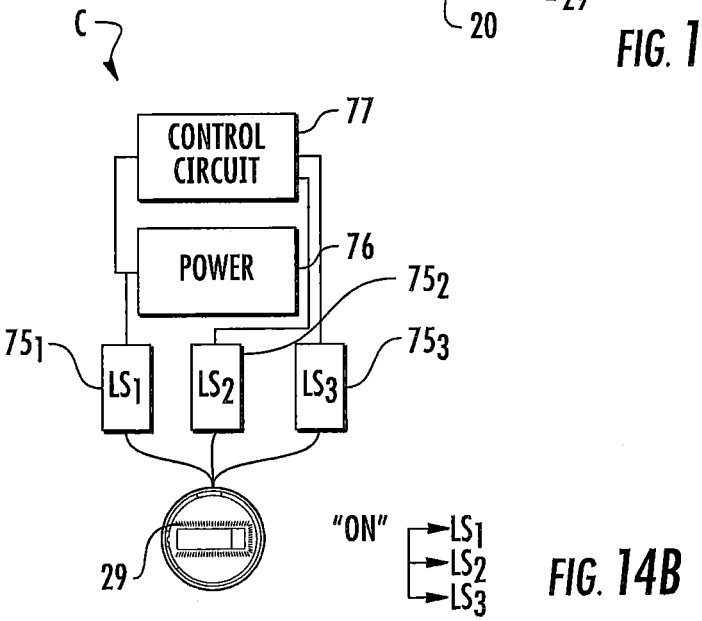

FIGS. 13A and 13B illustrate that the handle 10 can be configured with an externally visible surface or segment 29 that can be illuminated with a light source 75 (FIGS. 14A, 14B). This surface or segment 29 can be transparent or translucent or a surface of a material that is sufficiently thin to be illuminated indirectly, for example. The light illuminatable surface or segment 29 can be selectively illuminated to indicate an operational problem or status associated with the circuit breaker, such as, for example, a TRIP indication or blown fuse indication. The light source 75 that can be held inside the handle 10 or be held in the unit 110 or other structure to which the handle 10 is attached and be in communication with the lever 20.

Figure 13C:
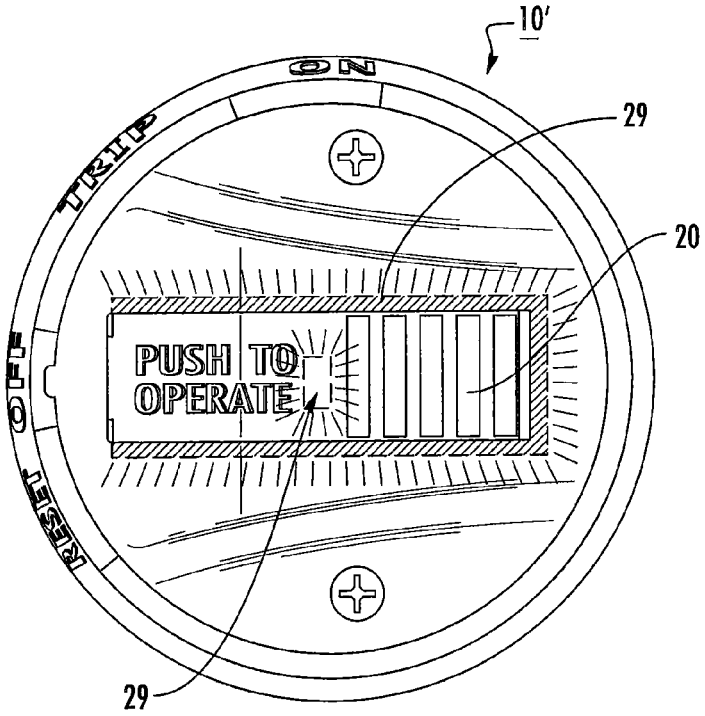
FIG. 13C is a front view of an alternate embodiment of a light illuminating segment according to embodiments of the present invention.

As shown in FIGS. 13A and 13B, the light illuminating segment 29 is adjacent the rear end portion of the lever 20*r*, between the cover 30 and the lever 20*r*. However, as shown in FIG. 13C, for example, the light illuminating segment 29 can be about substantially the entire perimeter of the lever 20 via light guides to the upper surface of the cover 30 about the elongate channel 35. The light illuminating surface or segment 29 can comprise visually transmissive material, such as translucent or transparent material. In some embodiments, the lever 20 itself can include a light illuminating segment via appropriately configured internal light guides as schematically shown in FIG. 13C.

Figure 13D:
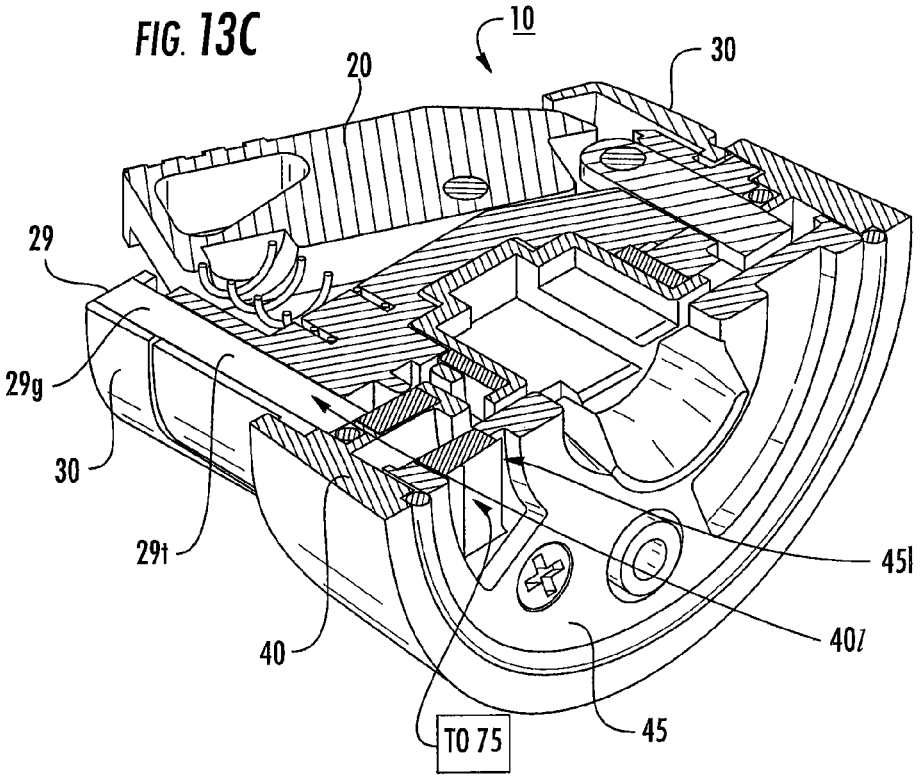
FIG. 13D is a section view of the handle shown in FIGS. 13A and 13B according to some embodiments of the present invention.

FIG. 13D illustrates one example of a light path provided using a light guide comprising a visually transmissive tube 29*t*, such as a polycarbonate light guide/tube that visually communicates with a light source such as an LED, positioned behind the handle 10 in or on the attached structure such as bucket unit 110 (FIGS. 15A, 15B). Light paths 40*l*, 45*l* can be formed in the base 40 and cover 45. The light paths 40*l*, 45*l* are arranged in the base 40 and cover 44 to allow the light to hit the light pipe 29*t*. In the embodiment shown, there is a single light guide tube 29*g*, shown as a light guide tube 29*t*, which extends to form the outer light illuminating segment 29. However, as discussed above, the light guide 29*t* can be configured to disperse the light about the perimeter of one or both long and/or short sides of the lever 20 (FIG. 13C). More than one light guide may be used and more than one light source may be used. The light source 75 preferably comprises at least one LED, but other light sources may be used. The light guide 29*g* may comprise fiber optic fibers or other light guides as is known to those of skill in the art.

The light source can be configured to be selectively illuminated, such as, for example, when the handle 10 is in the TRIP position.

In some embodiments, the cover 45 and base 40 can include light path apertures specifically positioned to align with the light guide 29*g* in TRIP, OFF & RESET positions and blocked on the ON position. However, in other embodiments, different colors can be transmitted to the light guide 29*g* depending on an operational condition using different color sources not blocking the light path from the source for any position. For example, the ON is not blocked and the LED color is different for each position, e.g., RED for ON, YELLOW for TRIPPED and GREEN for OFF. Other color-condition combinations may be selected or used.

FIGS. 14A and 14B are schematic illustrations of a circuit breaker C with an operator handle 10 having an externally visual, light-illumination segment 29. As shown in FIG. 14A, the circuit breaker C includes a control circuit 77, a light source 75 and a power source 76 for the light source. The control circuit 77 controls when to power the light source to illuminate the segment 29, typically when a Trip condition or blown fuse is detected.

FIG. 14B illustrates that the light source 75 can be a plurality of different light sources $\mathbf{75}_1$, $\mathbf{75}_2$, $\mathbf{75}_3$, (LS1, LS2, LS3), each of which can output a different color light or the same light to a different segment 29 of the handle 10. Typically, the different light sources comprise one or more LEDs to generate different colors in the visible spectrum (as used herein white and black are considered colors).

FIGS. 15A and 15B illustrate and example of a bucket assembly or unit 110. The bucket assembly can be configured for DC (direct current) and/or AC (alternating current) operation. The bucket assembly 110 can include a front cover 111*c*. The bucket assembly can include at least one door 122 under the front cover. The bucket assembly 110 can have a metal frame or housing.

Figure 16:
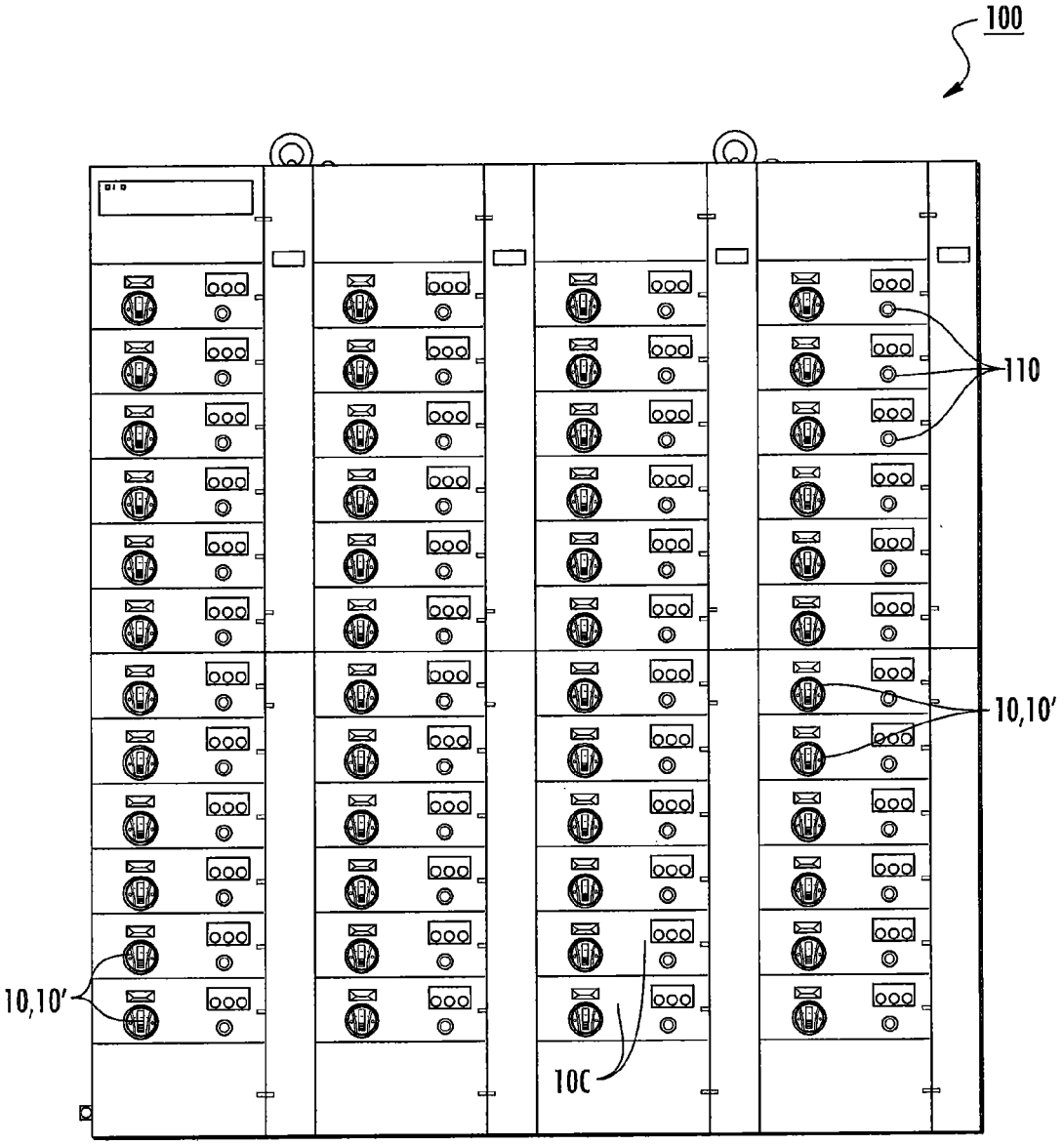
FIG. 16 is a front view of an exemplary Motor Control Center cabinet according to embodiments of the present invention.

In some embodiments, the bucket assembly 110 can comprise a molded case circuit breaker. Molded case circuit breakers are well known to those of skill in the art, as exemplified by U.S. Pat. Nos. 4,503,408 and 5,910,760, the contents of which are incorporated herein by reference as if recited in full herein. In other embodiments, the bucket assembly 10 can be configured to house a fuse disconnect with a fuse disconnect switch to turn power on and off. In some embodiments, as shown in FIG. 16, the handles 10 can be provided on units 110 held in a MCC cabinet 100.

As is known by those of skill in the art, the unit 110 can include an internal operator disconnect mechanism 130 that is attached to the shaft 125 that is held by the shaft holder 46 of the rotary handle 10. In operation, the orientation of the lever 20 of the rotary handle 10 can provide a visual indication of the conduction status of the operator disconnect, e.g., breaker 160 (FIG. 15A) or ON/OFF switch for the fuse disconnect switch (not shown). See, FIGS. 9A/9B of U.S. Provisional Application Ser. No. 61/890,495, the contents of which are hereby incorporated by reference as if recited in full herein.

As discussed above, the handle 10 rotates between different operative and defined positions, e.g., ON/RESET/OFF positions. FIGS. 17A, 17B, 18A-18C, and 19-23 illustrate that the handle 10 can include an on-board toggle-assist mechanism 165 that does not require the lever resilient member 60. As discussed above with respect to the embodiments shown in FIGS. 8A and 8B, in operation, the handle 10 with the toggle-assist mechanism 165 can be configured to make sure the interlock pin 65 can only lock (extend down) and the lever 29 can only pop-out, when the handle 20 is rotated to the RESET position.

The handle 10 can be configured to have sufficient rotational torque so that when the rotating handle 10 with the padlocking lever 20, the handle 10 can toggle to and from each position, typically with a slight snap action. The on-board toggle-assist mechanism 165 can prevent the handle 20 from stalling when a unit or bucket with a breaker is tripped, particularly where a trip assist spring in the unit itself (where used) may not be strong enough to reliably cause the proper movement, and/or can facilitate desired rotational movement between operative positions.

As noted above, the handle 10 can be configured without requiring the "pop-out" lever spring 60 under the rear of the lever 20 as described above for some embodiments. The toggle-assist mechanism 165 can alternatively or additionally include a resilient member 160 that can push open the lever 20 to provide external access to the padlock portal 25 and that can angularly flex to provide rotational torque to facilitate movement between operative positions.

Referring now to FIGS. 17A and 17B, in some embodiments, the on-board toggle-assist mechanism 165 of the handle 10 can include a resilient member 160, shown as a coil spring by way of example, held adjacent the interlock or lockout pin 65.

The resilient member 160 can be held in a cavity 144 in the core 44 and can reside under the pivot attachment 28 of the lever 20. The resilient member 160 can be held trapped between the lever 20 and the cavity 144 and can both compress and extend and flex side-to-side in the cavity 144 to angularly flex to take on different shapes as the handle 10 rotates and provide rotational torque to assist movement between one or more operative positions.

The resilient member 160 can comprise one or more of a flexible solid or hollow elastic plug, block or other shaped elastic members, O-rings, stacked dome or spring washers, Belleville washers, coil springs, leaf springs, and the like and combinations of the above.

The toggle-assist mechanism 165 can include a leg 166 (as an outer anchor) that extends inward (shown as down in the orientation shown in FIGS. 17A, 17B) a distance under the lever 20. The cavity 144 can include a protrusion 145 that forms a lower anchor or retention feature for the resilient member 160. The cavity 144 can have a tapered shape with four opposing flat sidewalls 144*w* that taper apart in a direction toward the lever 20 (FIGS. 17A, 17B, 18A, 18B and 21). In some embodiments, other shapes of cavities 144 may be used including, for example, cylindrical, frustoconical and the like (not shown).

The leg 166 can pivot or remain in a static position as the lever 20 moves between the extended (FIG. 17B) and the retracted (FIG. 17A) positions. In any event, the leg 166 can push an adjacent end portion 160*a* (upper end as shown) of the resilient member (e.g., spring) to the left or inward toward a sidewall 144*w* when the lever 20 is retracted or down (FIG. 17A) and push the adjacent end portion 160*a* to the right or outward in the cavity 144, toward the other sidewall 144*w*, typically against the other sidewall 144*w*, when the lever 10 is extended (FIG. 17B).

The resilient member 160 can be pre-loaded at assembly to have a compressed shape in the cavity 144, whether the lever 20 is extended (FIG. 17B) or retracted (FIG. 17A) and may even have substantially the same compression (e.g., within about 20%) in each of these two positions. However, the resilient member 160 can be configured to extend outward a distance when the handle interlock is latched (FIG. 17B) while still remaining in a compressed configuration, e.g., the resilient member 160 may not fully decompress or be able to take on a fully expanded configuration when trapped under the lever 20 when the lever 20 is opened to provide access to the padlock portal 25.

FIGS. 17A and 17B also illustrate a downward pointing arrow pointing to the portions of the lever where a user can push down (apply force) to access the padlock portal 25, e.g., a user can push down on the front end portion of the lever as shown in FIG. 17A. To close the padlock portal 25, a user can push down on the rear end portion of the lever as shown in FIG. 17B.

The resilient member 160 is not required to be physically attached to the leg 166 or the cavity protrusion 145, but is trapped under the lever 20 with one or both opposing outer ends allowed to angularly flex sufficiently enough to provide rotational torque to allow the rotating padlocking lever to toggle to and from each position with a slight snap action (which can typically be manually felt via a tactile response to a user).

Figure 18A:
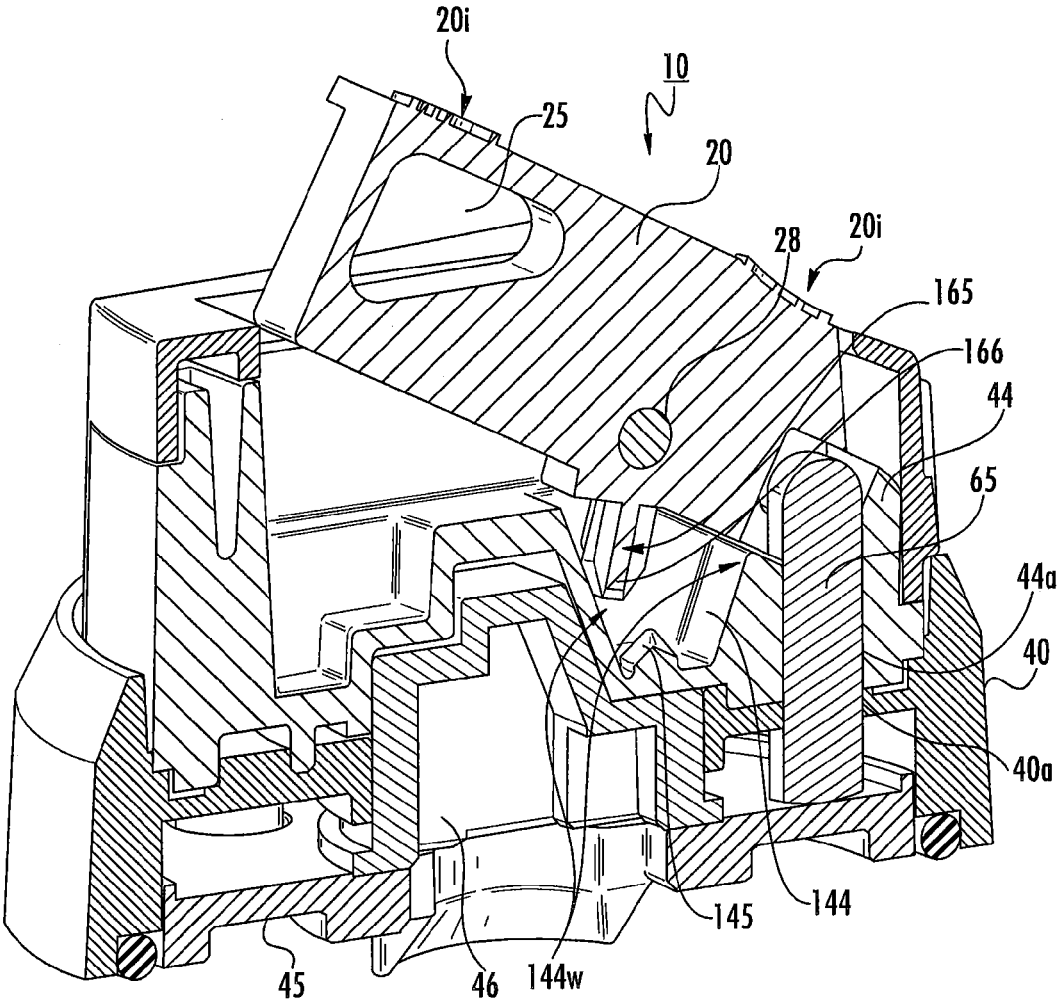
FIG. 18A is a rear, side perspective section view of the handle shown in FIGS. 17A and 17B.
Figure 18B:
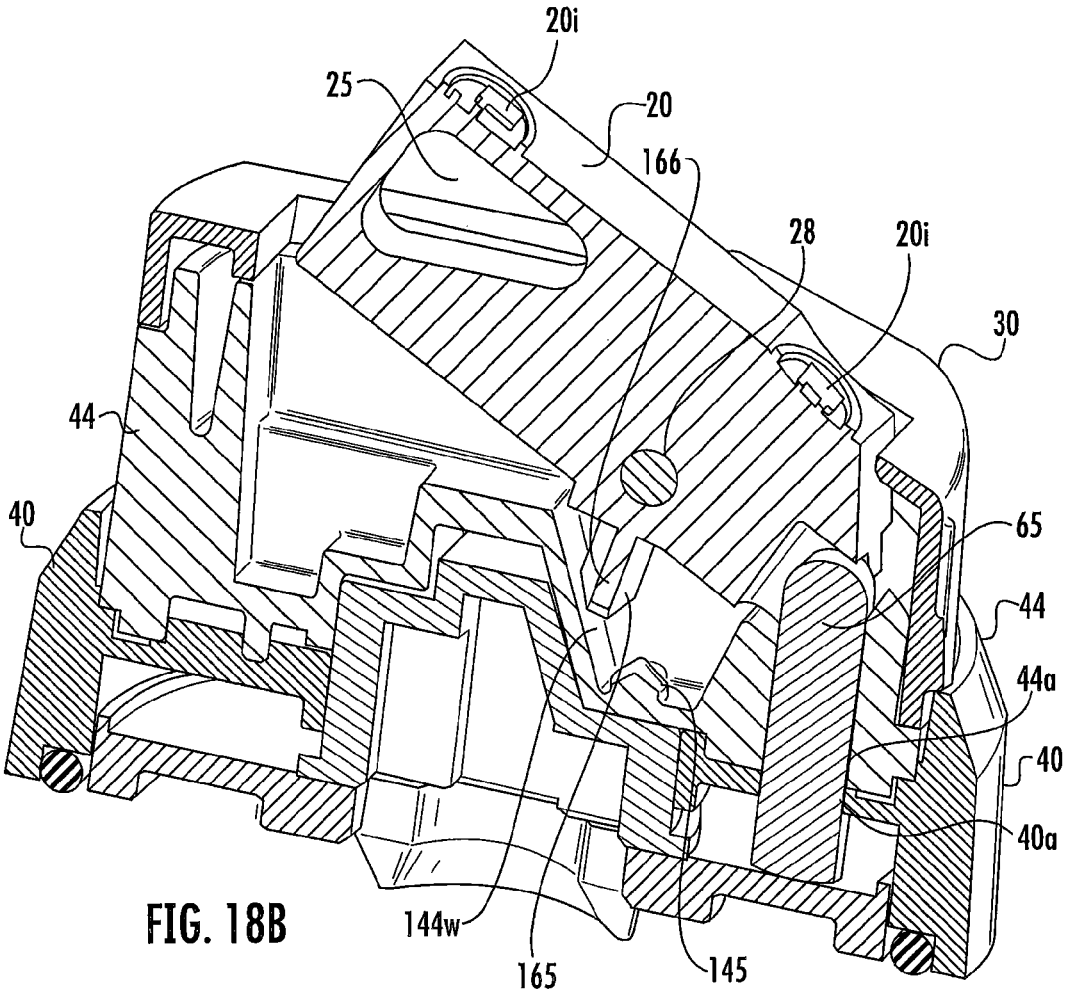
FIG. 18B is a front, side perspective section view of the handle shown in FIGS. 17A and 17B according to embodiments of the present invention.

FIGS. 18A and 18B show the handle 10 and on-board toggle assist mechanism 165 without the resilient member 160 and without the spring 60 (FIGS. 6, 7, 8A-8B, for example). FIGS. 17B, 18A and 18B show the interlock pin 65 extended down through the base aperture 40*a* and the handle core aperture 44*a* in the lock position.

Figure 18C:
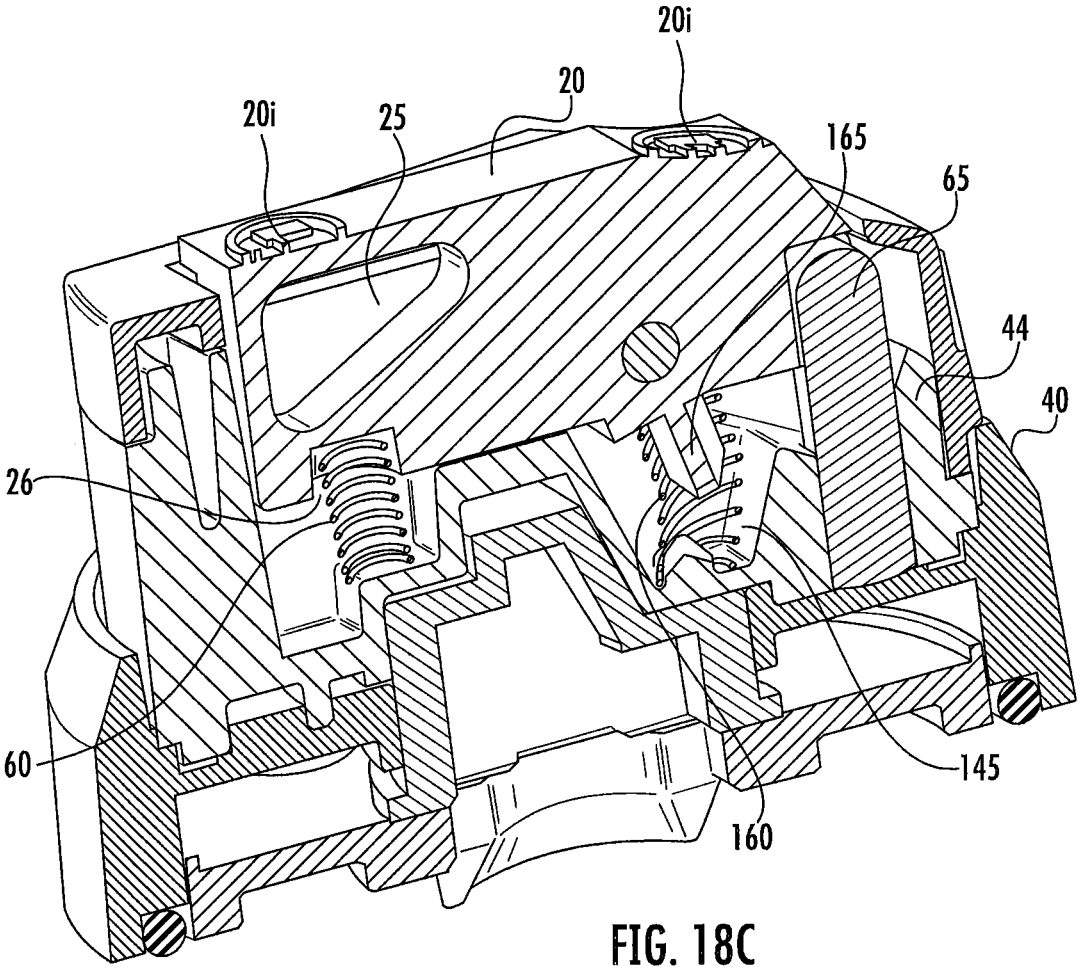
FIG. 18C is a top perspective section view of the handle shown in FIGS. 17A and 17B and resilient members shown positioned under the lever according to embodiments of the present invention.

FIGS. 17A and 18C illustrate the interlock pin 65 disengaged (unlocked) and residing proximate the core aperture 44*a* above the base 40.

FIG. 18C also illustrates that that the handle 10 may optionally include a resilient member 60 that is under the rear end portion of the lever 20 (under the padlock portal 25). The resilient member 60, as discussed above, can comprise a coil spring 60 and the toggle assist resilient member 160 can also comprise a coil spring.

However, as noted above, in some embodiments, the lever 20 may operate without requiring the resilient member 60 under the rear end portion of the lever 20 with the toggle-assist mechanism 165 and/or may use both resilient members 60, 160 (FIG. 18C). For the former, the toggle-assist mechanism 165 opens and closes the padlock portal 25 when the lever 20 is depressed on the corresponding end portion, that may be visually marked with visual indicia such as a "lock" and "unlock" icon or push to open/close text, and the like.

FIGS. 19A and 19B are similar to FIGS. 6 and 7 above but illustrate the toggle assist mechanism 165 with leg 166 and a toggle assist cavity 144 in the core 44 and do not require the spring 60 or spring cavities 26, 44*s*.

In some embodiments, the cavity 144 is not required to have the protrusion and the leg 166 can be configured in other manners.

Figure 20:
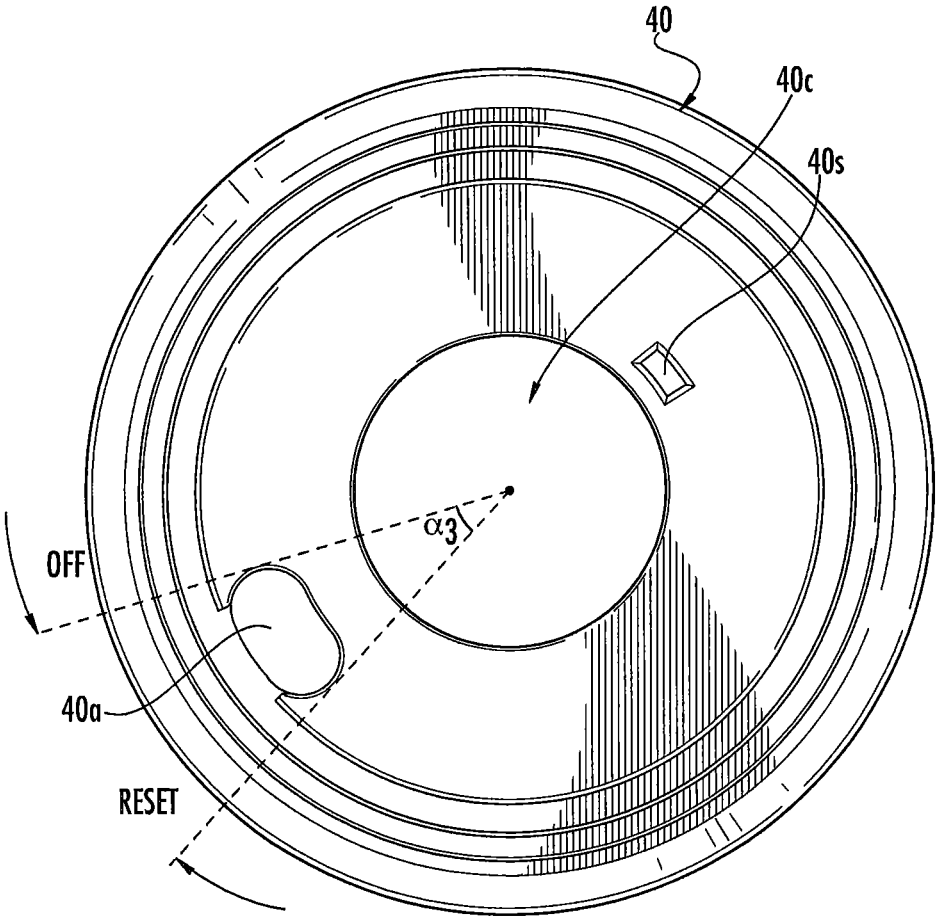
FIG. 20 is a greatly enlarged front view of an example of a base of the disconnect operating handle according to embodiments of the present invention.

FIG. 20 is an enlarged view of the base 40 with the base aperture 40*a* for the interlock pin 65 in the RESET position and an optional detent feature 40*s*, which may be diametrically opposed from a center of the aperture 40*a*.

Figure 21:
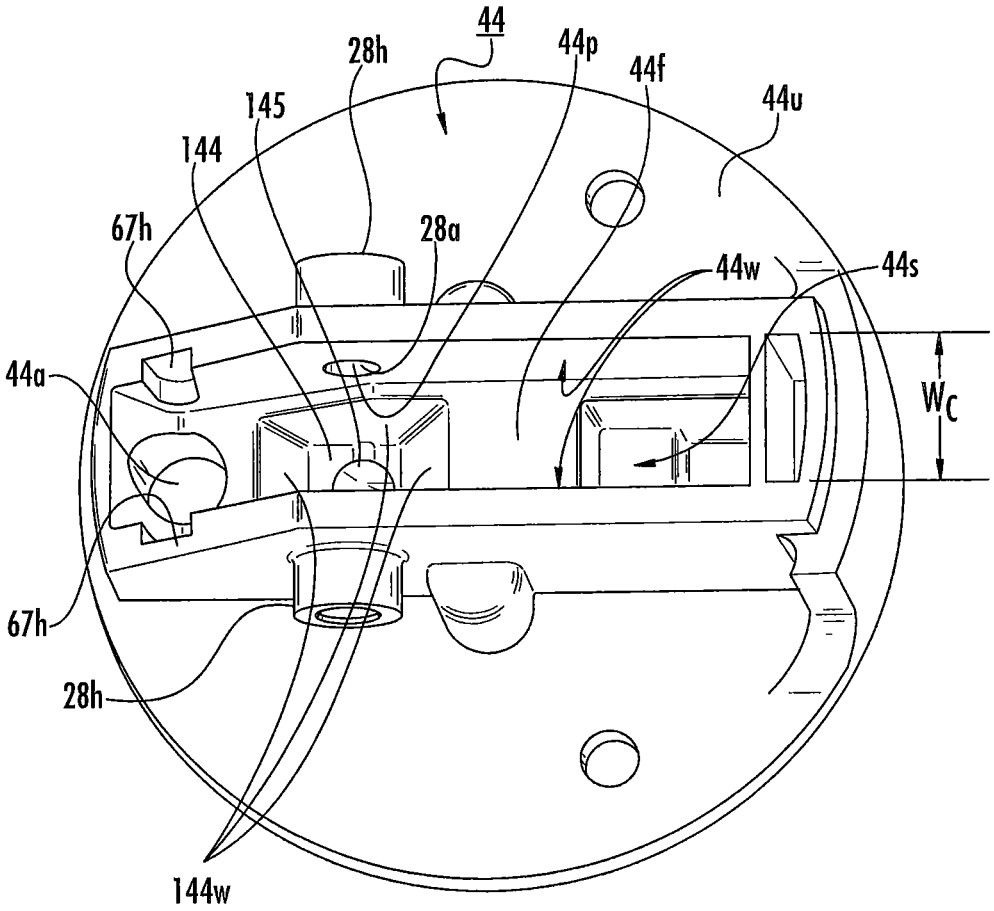
FIG. 21 is a greatly enlarged top/front view of the handle core according to embodiments of the present invention.

FIG. 21 is an enlarged view of the core 44 according to embodiments of the present invention. The core 44 can include features similar to that discussed above for FIG. 11 with cavity 144 and can include an optional protrusion 145 according to embodiments of the present invention.

Figure 22:
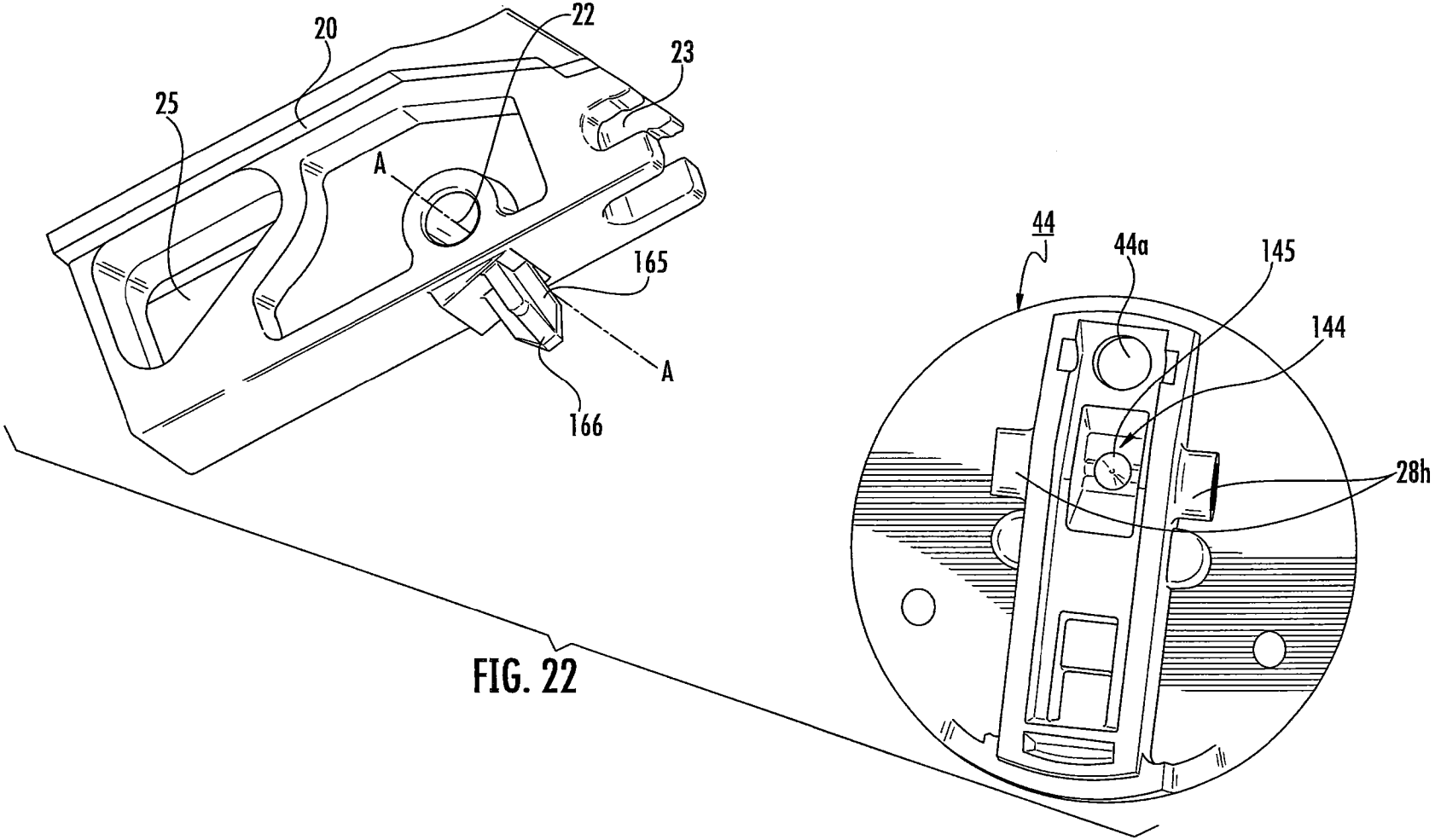
FIG. 22 is a side perspective, exploded view of a lever and cooperating core member according to embodiments of the present invention.

FIG. 22 illustrates an example of a toggle-assist mechanism 165 with a leg 166 that faces the core 44 under a hinge axis A-A of the lever 20 adjacent the aperture 44*a* for the interlock pin 65.

FIGS. 23A, 23B and 24A, 24B illustrate that the handle 10 can include a magnetic latch 175 that can latch the lever 20 against the core 44 to allow the core 44 and lever 20 to rotate locked together, substantially, if not totally, friction-free, when latched.

The magnetic latches 175 can be used with any of the embodiments shown and/or described herein.

Figure 23A:
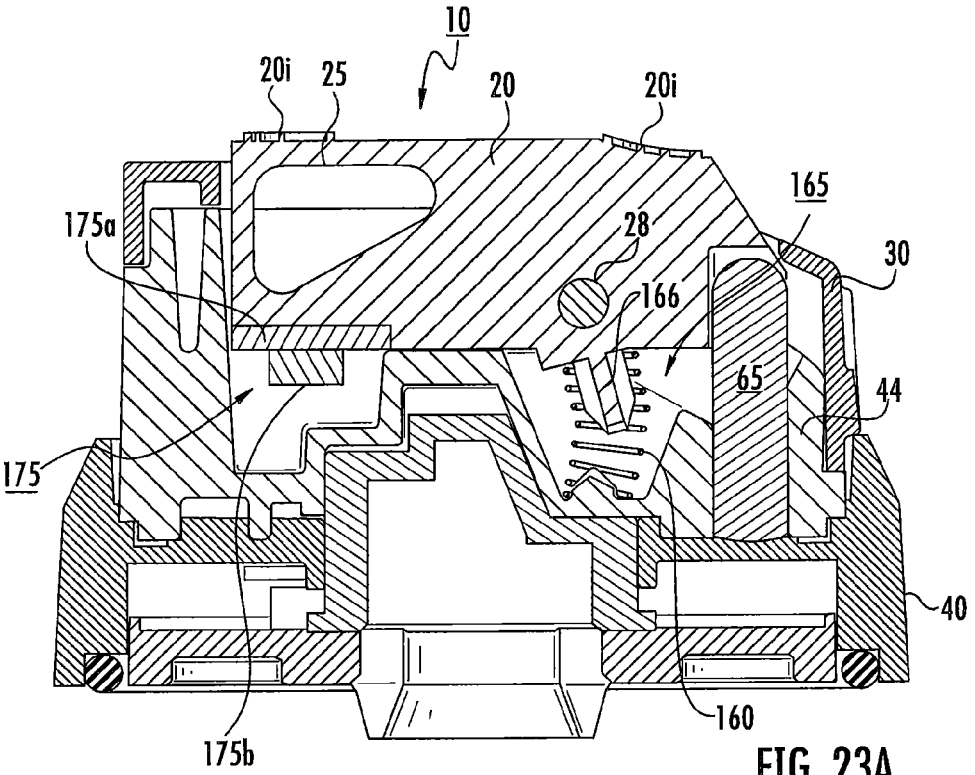
FIG. 23A is a section view showing another embodiment of a handle with a magnetic latch and handle interlock illustrating an interconnect pin disengaged and the lever in a non-padlock (non-extended) configuration according to embodiments of the present invention.
Figure 23B:
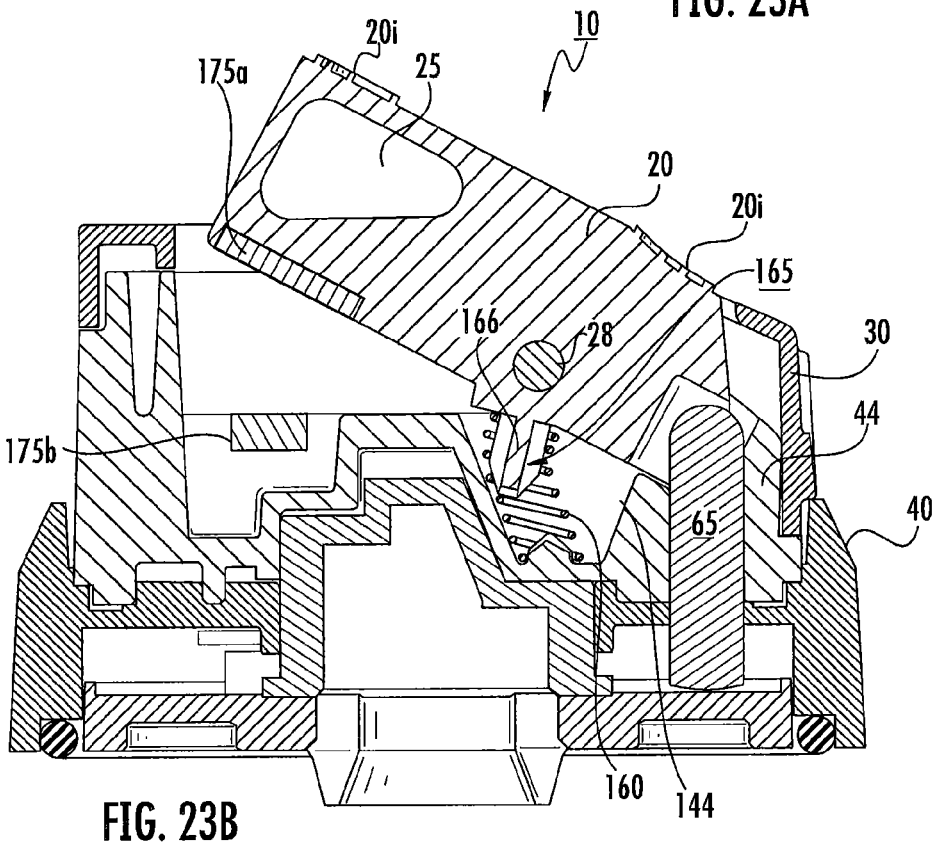
FIG. 23B illustrates the device shown in FIG. 23A but with the magnetic latch unlatched, the padlock portal extended and the interlock pin engaged according to embodiments of the present invention.

In some embodiments, as shown in FIGS. 23A and 23B, the magnetic latch 175 can be used with the toggle-assist mechanism 165. Once the latch 175 is released, the toggle-assist resilient member 160 can pop-open and/or push the front end portion of the lever 20 upward to expose the portal 25 and therefore only allow access to the padlock portal 25 when the handle 10 is in a defined operative position, when the interlock pin 65 is extended down in locked engagement (FIG. 23B). The magnetic latch 175 can comprise at least one (rare earth) permanent magnet 175*b* that can latch to an upper member 175*a* held by the lever 20. The upper member 175*a* can be a metallic member or surface on or in the lever 20. In other embodiments, the upper member 175*a* can comprise a (rare earth) magnet. The top member 175*a* can be attached to the lever 20 at a location that is directly under the padlock portal 25 (as shown) or may reside between the pivot and the end portion of the lever 20. The lower magnet 175*b* can reside closely adjacent to the first magnet 175*b*, when the lever 20 is closed, typically held by the core 44 (directly or indirectly) to be in cooperating alignment to provide a sufficient latch force.

Figure 24A:
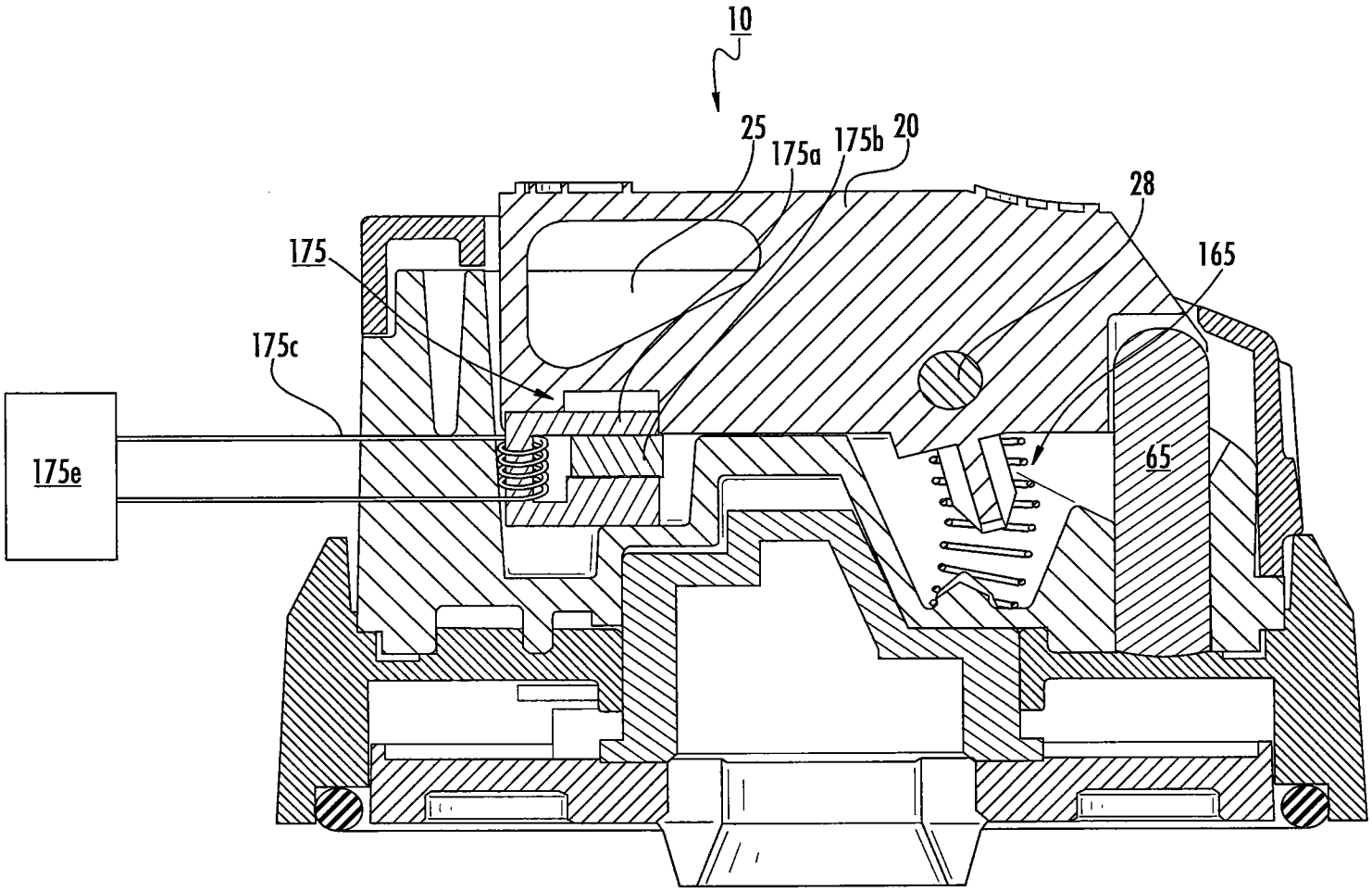
FIG. 24A is a section view showing another embodiment of a handle with another embodiment of a magnetic latch and handle interlock illustrating an interconnect pin disengaged and the lever in a non-padlock (non-extended) configuration according to embodiments of the present invention.
Figure 24B:
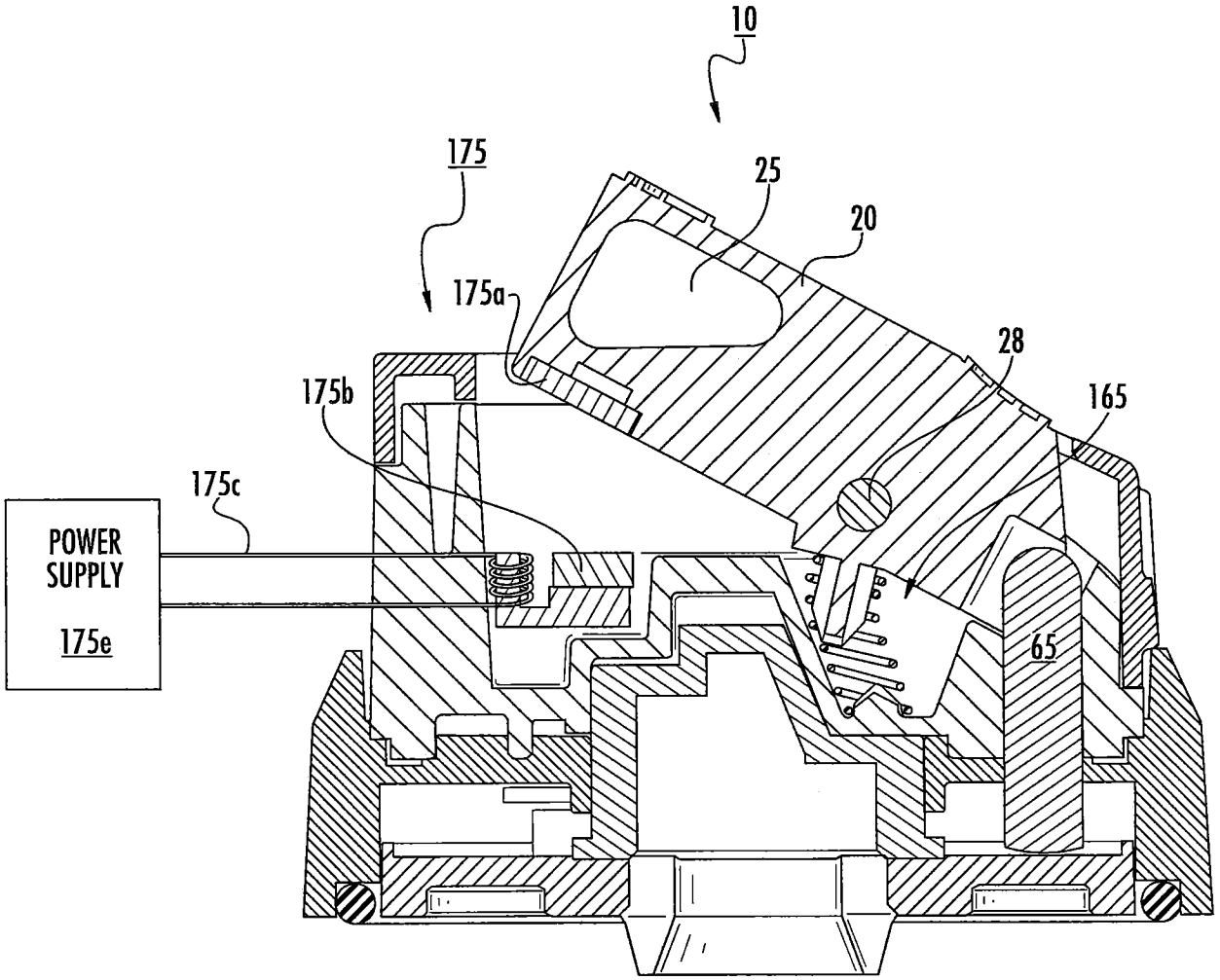
FIG. 24B illustrates the device shown in FIG. 24A but with the magnetic latch disengaged, the padlock portal extended and the interlock pin engaged according to embodiments of the present invention.

FIGS. 24A and 24B illustrate another embodiment of the magnetic latch 175. In this embodiment, the magnetic latch 175 can have a circuit 175*c* that is in communication with a DC power supply to allow an electric (direct current/DC) pulse 175*e* to be applied to the circuit 17*c* to demagnetize and/or counteract the magnetic force produced by the magnet 175*b* to electrically release the lever 20 to allow the padlock portal access. The DC pulse provided by the coil of circuit 175*c* produces a magnetic flux that opposes that of the permanent magnet. The magnetic latch 175 can operate using flux shift. See, e.g., U.S. Pat. No. 4,679,019 describing flux shift used for tripping a circuit breaker, the contents of which are hereby incorporated by reference as if recited in full herein.

Also, the spring 160 can be configured to be positioned to the left or right of the pivot 28, rather than directly under the pivot 28, but to the left or inside of interlock 65.

In some embodiments, the resilient member 160, e.g., spring, can be configured to reside between the pivot 28 and the padlock portal 25 and this placement can allow the resilient member 160 to act in a similar or same manner as the spring 60.

In some embodiments, where a magnetic latch 175 is used, the spring 160 can hold the padlock portal 25 open and the magnet latch 175 can latch it closed.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention. Therefore, it is to be understood that the foregoing is illustrative of the present invention and is not to be construed as limited to the specific embodiments disclosed, and that modifications to the disclosed embodiments, as well as other embodiments, are intended to be included within the scope of the invention.

That which is claimed is:

1. A disconnect operator handle, comprising:

an outer cover having a channel;

a lockout lever having a primary body with opposing spaced apart first and second end portions held in the channel, the second end portion of the lockout lever configured to pivot outward from the channel and expose a lockout passage residing under an outer surface of the lever;

a lever pivot pin attached to the lever to pivotably hold the lever in the outer cover channel; and at least one resilient member in communication with the lever, wherein the at least one resilient member extends inward under the primary body of the lever, spaced apart from the lever pivot pin and is held in at least a partially compressed state.

2. The disconnect operator handle of claim 1, wherein the lever is an elongate lever that has a transverse channel residing between the first and second end portions and the lever pivot pin resides in the transverse channel, wherein the lockout lever comprises an inwardly extending leg positioned under and adjacent the lever pivot pin, wherein the leg extends through a center of at least one of the at least one resilient member into a cavity, and wherein, in operation, the leg pivots back and forth causing the resilient member to flex angularly to thereby provide rotational torque for a toggle-assist action of the handle between operative positions.

3. The disconnect operator handle of claim 1, further comprising a handle core with outwardly extending spaced apart walls, each with a respective pivot pin holder, wherein the lever resides between the handle core walls with the lever pivot pin extending into the handle core pivot pin holders.

4. The disconnect operator handle of claim 1, further comprising at least one light illuminating surface proximate the lever or in the lever that is externally visible and configured to be illuminated from a light path extending within the operator handle.

5. The disconnect operator handle of claim 1, further comprising a base that holds the cover with the lever to a housing panel of a circuit breaker and allows the cover and lever to rotate through defined operational positions, wherein the base holds a drive shaft holder and comprises an aperture that slidably receives at least one lockout pin to inhibit or prevent handle rotation out of a defined operating position when the lever is extended to expose the lockout passage.

6. The disconnect operator handle of claim 1, wherein the at least one resilient member comprises a spring held under the pivot pin of the lever that presses outward against a bottom surface of the lever to force the second end portion of the lever to pivot outward in response to when a user depresses the lever at a defined end portion of the lever.

7. The disconnect operator handle of claim 1, further comprising:

a handle core residing under the cover with outwardly extending spaced apart walls defining a cavity therebetween, each with a respective pivot pin holder, wherein the lever resides between the handle core spaced apart walls in the cavity with the lever pivot pin extending into the pivot pin holders;

a base that resides under and is attached to the handle core, the base adapted to hold the handle core, the cover with the lever to a housing panel of a circuit breaker and allows the handle core, the cover and the lever to rotate as a unit through defined operational positions; and at least one lockout pin held by the first end portion of the lever, the at least one lockout pin extending inwardly a length sufficient to extend through an aperture in the base to lock the handle core, cover and lever in a defined operational position when the second end portion of the lever is pivoted outward to expose the lockout passage with the first end portion of the elongate lever is pivoted inward.

8. The disconnect operator handle of claim 7, wherein the at least one lockout pin is a single lockout pin and includes an aperture in a top end portion thereof, the disconnect operator further comprising a retainer pin extending through the single lockout pin in a direction that is perpendicular to the single lockout pin and the retainer pin extends through a cooperating front end portion of the elongate lever to hold the single lockout pin to the lever.

9. The disconnect operator of claim 1, further comprising:

at least one inwardly extending lockout pin held by the front end portion of the lever; and a circular handle core residing under the cover, the handle core having an outer surface comprising a pair of outwardly extending spaced apart walls, each with a respective pivot pin holder, wherein the lever resides between the handle core walls with the lever pivot pin extending into the pivot pin holders.

10. The disconnect operator of claim 9, wherein the outer surface of the handle core includes a flat segment between the walls that merges into an adjacent segment that angles inward or down toward the front end portion of the lever, wherein the pivot pin holders reside above and adjacent a peak that transitions the flat segment to the angled segment.

11. The disconnect operator of claim 1, wherein the at least one resilient member resides under the lever pivot pin in a cavity in a handle core and is configured to be held trapped between a leg extending below the lever in the cavity in the at least partially compressed state while being able to flex angularly in the cavity to move radially inward and outward at a top portion thereof to thereby provide rotational torque for a toggle-assist action of the handle between operative positions.

12. A disconnect operator handle, comprising:

an outer cover having a channel;

a lockout lever having opposing spaced apart first and second end portions held in the channel, the second end portion of the lockout lever configured to pivot outward from the channel and expose a lockout passage residing under an outer surface of the lever;

a lever pivot pin attached to the lever to pivotably hold the lever in the outer cover channel;

at least one resilient member residing under and in communication with the lever, wherein the resilient member pushes the lever outward to expose the lockout passage;

a handle core with outwardly extending spaced apart walls, each with a respective pivot pin holder, wherein the lever resides between the handle core walls with the lever pivot pin extending into the handle core pivot pin holders;

at least one lockout pin held by the first end portion of the lever, the at least one lockout pin extending inwardly; and a magnetic latch comprising at least one permanent magnet held by the handle core under a second end portion of the lever, the magnetic latch configured to latch the lever to the handle core so that the handle core, outer cover and lever can rotate as a unit when latched.

13. A disconnect operator handle, comprising:

an outer cover having a channel;

a lockout lever having opposing spaced apart first and second end portions held in the channel, the second end portion of the lockout lever configured to pivot outward from the channel and expose a lockout passage residing under an outer surface of the lever;

a lever pivot pin attached to the lever to pivotably hold the lever in the outer cover channel;

at least one resilient member residing under and in communication with the lever, wherein the resilient member pushes the lever outward to expose the lockout passage; and a handle core attached to a base and the cover, wherein the base has an aperture that has a configuration adapted to allow a limited defined circumferential movement of the cover, lever and core as a unit in an OFF position, and wherein the base comprises a cantilevered locator feature on an inner perimeter thereof that cooperates with underlying surface features at defined positions associated with OFF/RESET and ON, respectively, to provide a detent for the handle.

14. A disconnect operator handle, comprising:

an outer cover having a channel;

a lockout lever having opposing spaced apart first and second end portions held in the channel, the second end portion of the lockout lever configured to pivot outward from the channel and expose a lockout passage residing under an outer surface of the lever;

a lever pivot pin attached to the lever to pivotably hold the lever in the outer cover channel;

at least one resilient member residing under and in communication with the lever, wherein the resilient member pushes the lever outward to expose the lockout passage; and at least one light illuminating segment proximate the lever or in the lever that is externally visible and a light guide extending through the handle core to a location between the second end portion of the lever and an external surface of the cover thereat, wherein the light guide comprises a light pipe held by the handle core and the cover.

15. A bucket assembly for a circuit breaker, comprising:

a rotary operating mechanism disconnect handle attached to the bucket assembly having a defined ON position and OFF position associated with conduction and non-conduction; and a shaft attached to the rotary handle and extending into the bucket assembly, wherein the operating mechanism disconnect handle comprises:

a base fixedly attached to the bucket assembly;

an outer cover with an elongate channel attached to the base;

an elongate lockout lever having a primary body with opposing spaced apart first and second end portions held in the elongate channel of the outer cover, the second end portion of the elongate lockout lever configured to be able to pivot outward from the elongate channel and expose a lockout passage residing under an outer surface of the lever;

a lever pivot pin attached to the elongate lever to pivotably hold the lever in the elongate channel; and at least one resilient member residing under and in communication with the lever, wherein the at least one resilient member extends inward under the primary body of the lever, wherein the outer cover with the lever rotates to the defined ON and OFF positions while the base remains in a fixed position attached to the bucket assembly, and wherein the base comprises a circumferentially extending cantilevered arm on an inner perimeter thereof that cooperates with underlying aligned surface features at respective ON and OFF/RESET positions to provide a detent for the handle.

16. The bucket assembly of claim 15, wherein the rotary operating mechanism disconnect handle comprises at least one lockout pin held by the first end portion of the elongate lever, the at least one lockout pin extending inwardly a length sufficient to extend through an aperture in the base to lock the cover and lever in a defined operational position when the second end portion of the lever is pivoted outward in response to when a user depresses the lever, to expose the lockout passage and the first end portion of the elongate lever is pivoted inward.

17. The bucket assembly of claim 16, wherein the rotary operating mechanism disconnect handle comprises a circular handle core residing between the base and cover, the handle core comprising an outer surface comprising a pair of outwardly extending spaced apart walls, each with a respective pivot pin holder, wherein the lever resides between the handle core walls with the lever pivot pin extending into the pivot pin holders.

18. A bucket assembly for a circuit breaker, comprising:

a rotary operating mechanism disconnect handle attached to the bucket assembly having a defined ON position and OFF position associated with conduction and non-conduction; and a shaft attached to the rotary handle and extending into the bucket assembly, wherein the operating mechanism disconnect handle comprises:

a base fixedly attached to the bucket assembly;

an outer cover with an elongate channel attached to the base;

an elongate lockout lever having a primary body with opposing spaced apart first and second end portions held in the elongate channel of the outer cover, the second end portion of the elongate lockout lever configured to be able to pivot outward from the elongate channel and expose a lockout passage residing under an outer surface of the lever;

a lever pivot pin attached to the elongate lever to pivotably hold the lever in the elongate channel; and at least one resilient member residing under and in communication with the lever, wherein the at least one resilient member extends inward under the primary body of the lever, wherein the outer cover with the lever rotates to the defined ON and OFF positions while the base remains in a fixed position attached to the bucket assembly, wherein the rotary operating mechanism disconnect handle comprises at least one lockout pin held by the first end portion of the elongate lever, the at least one lockout pin extending inwardly a length sufficient to extend through an aperture in the base to lock the cover and lever in a defined operational position when the second end portion of the lever is pivoted outward in response to when a user depresses the lever, to expose the lockout passage and the first end portion of the elongate lever is pivoted inward, wherein the rotary operating mechanism disconnect handle comprises a circular handle core residing between the base and cover, the handle core comprising an outer surface comprising a pair of outwardly extending spaced apart walls, each with a respective pivot pin holder, wherein the lever resides between the handle core walls with the lever pivot pin extending into the pivot pin holders, wherein the handle core further comprises an aperture residing on an outer perimeter aligned with the first end portion of the lever to allow the at least one lockout pin to extend therethrough, a resilient member retention feature or member residing between the walls under the lever, wherein the outer surface of the handle core includes a flat segment between the walls that merges into an adjacent segment that angles inward or down toward the front end portion of the lever, and wherein the pivot pin holders reside above and adjacent a peak that transitions the flat segment to the angled segment.

19. A bucket assembly for a circuit breaker, comprising:

a rotary operating mechanism disconnect handle attached to the bucket assembly having a defined ON position and OFF position associated with conduction and non-conduction; and a shaft attached to the rotary handle and extending into the bucket assembly, wherein the operating mechanism disconnect handle comprises:

a base fixedly attached to the bucket assembly;

an outer cover with an elongate channel attached to the base;

an elongate lockout lever having opposing spaced apart first and second end portions held in the elongate channel of the outer cover, the second end portion of the elongate lockout lever configured to be able to pivot outward from the elongate channel and expose a lockout passage residing under an outer surface of the lever;

a lever pivot pin attached to the elongate lever to pivotably hold the lever in the elongate channel;

at least one resilient member residing under and in communication with the lever, wherein the at least one resilient member pushes the lever outward to expose the lockout passage, and wherein the outer cover with the lever rotates to the defined ON and OFF positions while the base remains in a fixed position attached to the bucket assembly; and at least one light illuminating segment or surface residing proximate the lever and/or in the lever that is externally visible and at least one light guide extending through the rotary handle from a light source held in the bucket assembly to the at least one light illuminating segment or surface.

20. The bucket assembly of claim 19, wherein the light source comprises a plurality of LEDs (light emitting diodes) in different colors that selectively communicate with the at least one light guide to selectively illuminate the light illuminating segment with a color associated with a defined operational condition or status of the circuit breaker in the bucket assembly.

21. A bucket assembly for a circuit breaker, comprising:

a rotary operating mechanism disconnect handle attached to the bucket assembly having a defined ON position and OFF position associated with conduction and non-conduction; and a shaft attached to the rotary disconnect handle and extending into the bucket assembly, wherein the operating mechanism disconnect handle comprises:

a base fixedly attached to the bucket assembly;

an outer cover with an elongate channel attached to the base;

an elongate lockout lever having opposing spaced apart first and second end portions held in the elongate channel of the outer cover, the second end portion of the elongate lockout lever configured to be able to pivot outward from the elongate channel and expose a lockout passage residing under an outer surface of the lever;

a lever pivot pin attached to the elongate lever to pivotably hold the lever in the elongate channel;

at least one resilient member residing under and in communication with the lever, wherein the outer cover with the lever rotates to the defined ON and OFF positions while the base remains in a fixed position attached to the bucket assembly;

at least one lockout pin held by the first end portion of the elongate lever, the at least one lockout pin extending inwardly a length sufficient to extend through an aperture in the base to lock the cover and lever in a defined operational position when the second end portion of the lever is pivoted outward in response to when a user depresses the lever, to expose the lockout passage and the first end portion of the elongate lever is pivoted inward; and a circular handle core residing between the base and cover, the handle core comprising an outer surface comprising a pair of outwardly extending spaced apart walls, each with a respective pivot pin holder, wherein the lever resides between the handle core walls with the lever pivot pin extending into the pivot pin holders, wherein the at least one resilient member resides under the lever pivot pin in a cavity in the handle core and is configured to be held trapped between a leg extending below the lever in the cavity in at least a partially compressed state while being able to flex angularly in the cavity to move radially inward and outward at a top portion thereof to thereby provide rotational torque for a toggle-assist action of the handle between operative positions.

22. A bucket assembly for a circuit breaker, comprising:

a rotary operating mechanism disconnect handle attached to the bucket assembly having a defined ON position and OFF position associated with conduction and non-conduction; and a shaft attached to the rotary handle and extending into the bucket assembly, wherein the operating mechanism disconnect handle comprises:

a base fixedly attached to the bucket assembly;

an outer cover with an elongate channel attached to the base;

an elongate lockout lever having a primary body with opposing spaced apart first and second end portions held in the elongate channel of the outer cover, the second end portion of the elongate lockout lever configured to be able to pivot outward from the elongate channel and expose a lockout passage residing under an outer surface of the lever;

a lever pivot pin attached to the elongate lever to pivotably hold the lever in the elongate channel; and at least one resilient member residing under and in communication with the lever, wherein the at least one resilient member extends inward under the primary body of the lever, wherein the outer cover with the lever rotates to the defined ON and OFF positions while the base remains in a fixed position attached to the bucket assembly, wherein the operating mechanism disconnect handle further comprises a circular handle core residing between the base and cover and a magnetic latch comprising at least one permanent magnet held by the handle core under a second end portion of the lever, and wherein the magnetic latch is configured to latch the lever to the handle core so that the handle core, outer cover and lever can rotate as a unit when latched.

* * * * *